US009953609B2

(12) United States Patent
Kim et al.

(10) Patent No.: US 9,953,609 B2
(45) Date of Patent: Apr. 24, 2018

(54) DISPLAY PANEL DRIVING APPARATUS, METHOD OF DRIVING DISPLAY PANEL USING THE SAME AND DISPLAY APPARATUS HAVING THE SAME

(71) Applicant: SAMSUNG DISPLAY CO., LTD., Yongin-si, Gyeonggi-Do (KR)

(72) Inventors: Sung-Jun Kim, Cheonan-si (KR); Yong-Jae Lee, Seoul (KR); Kyung-Hwa Lim, Yongin-si (KR); Ki-Hyun Pyun, Gwangmyeong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 150 days.

(21) Appl. No.: 14/995,690

(22) Filed: Jan. 14, 2016

(65) Prior Publication Data

US 2016/0379588 A1 Dec. 29, 2016

(30) Foreign Application Priority Data

Jun. 24, 2015 (KR) ..... 10-2015-0089922

(51) Int. Cl.
*G09G 3/36* (2006.01)

(52) U.S. Cl.
CPC ..... *G09G 3/3696* (2013.01); *G09G 2310/08* (2013.01); *G09G 2320/02* (2013.01)

(58) Field of Classification Search
CPC .. G09G 3/30; G09G 3/34; G09G 3/36; G09G 5/00; G11C 19/00; G02F 1/1345; G06F 3/038
See application file for complete search history.

(56) References Cited

U.S. PATENT DOCUMENTS

2015/0067392 A1* 3/2015 Lim ..... G06F 1/12 714/15
2015/0221061 A1* 8/2015 Lee ..... G09G 3/2092 345/522
2015/0346887 A1* 12/2015 Cho ..... G06F 3/0412 345/174

FOREIGN PATENT DOCUMENTS

| | | |
|---|---|---|
| JP | 05-134625 | 5/1993 |
| KR | 100183698 | 12/1998 |
| KR | 1020000023013 | 4/2000 |
| KR | 1020070080477 | 8/2007 |

* cited by examiner

*Primary Examiner* — Pegeman Karimi
(74) *Attorney, Agent, or Firm* — F. Chau & Associates, LLC

(57) ABSTRACT

A display panel driving apparatus includes a control circuit, a data driver and a gate driver. The control circuit is configured to receive a first control signal for recovering a clock signal from a display signal including image data and the clock signal, and calculate a root mean square of the first control signal to output a second control signal. The data driver is configured to receive the display signal, receive the second control signal, recover the clock signal from the display signal according to the second control signal, and output a data signal based on the image data to a data line of a display panel. The gate driving part is configured to output a gate signal to a gate line of the display panel.

20 Claims, 17 Drawing Sheets

DISPLAY PANEL DRIVING APPARATUS, METHOD OF DRIVING DISPLAY PANEL USING THE SAME AND DISPLAY APPARATUS HAVING THE SAME

CROSS-REFERENCE TO RELATED APPLICATIONS

This application claims priority under 35 U.S.C. § 119 to Korean Patent Application No. 10-2015-0089922, filed on Jun. 24, 2015 in the Korean Intellectual Property Office (KIPO), the disclosure of which is incorporated by reference in its entirety herein.

BACKGROUND

1. Technical Field

Exemplary embodiments of the present inventive concept relate to a display panel driving apparatus, a method of driving a display panel using the display panel driving apparatus, and a display apparatus having the display panel driving apparatus.

2. Discussion of Related Art

A display apparatus such as a liquid crystal display apparatus includes a display panel and a display panel driving apparatus.

The display panel includes gate lines, data lines and pixels.

The display panel driving apparatus includes a gate driving part driving the gate line, a data driving part driving the data line, and a timing controlling part controlling a timing of the gate driving part and the data driving part.

The timing controlling part outputs a vertical start signal and a first clock signal to the gate driving part. In addition, the timing controlling part outputs image data, a horizontal start signal and a second clock signal to the data driving part. Here, the timing controlling part may transmit a display signal including the image data and the second clock signal to the data driving part through one line. In this case, the data driving part recovers the second clock signal from the display signal. The data driving part recovers the second clock signal from the display signal according to a recovery timing control signal.

However, when a distortion or a glitch is present in the recovery timing control signal, the data driving part may not be able to correctly recover the second clock signal.

SUMMARY

At least one exemplary embodiment of the present inventive concept provides a display panel driving apparatus capable of improving display quality of a display apparatus.

At least one exemplary embodiments of the present inventive concept provides a method of driving a display panel using the above-mentioned display panel driving apparatus.

At least one exemplary embodiment of the present inventive concept provides a display apparatus having the above-mentioned display panel driving apparatus.

According to an exemplary embodiment of the present inventive concept, a display panel driving apparatus includes a control circuit, a data driver and a gate driver.

The control circuit is configured to receive a first recovery timing control signal for controlling a recovery of a clock signal from a display signal including image data and the clock signal, calculate a root mean square of the first recovery timing control signal, and output a second recovery timing control signal. The data driver is configured to receive the display signal, receive the second recovery timing control signal from the control circuit, recover the clock signal from the display signal according to the second recovery timing control signal, and output a data signal based on the image data to a data line of a display panel. The gate driver is configured to output a gate signal to a gate line of the display panel.

In an exemplary embodiment, the control circuit calculates the root mean square of the first recovery timing control signal every reference time.

In an exemplary embodiment, the display panel driving apparatus further includes a detecting circuit configured to detect whether distortion is present in the first recovery timing control signal.

In an exemplary embodiment, the control circuit calculates the root mean square of the first recovery timing control signal while the distortion is present in the first recovery timing control signal.

In an exemplary embodiment, the first recovery timing control signal transits from a first level to a second level different from the first level or transits from the second level to the first level, and when a level of the second recovery timing control signal is closer to the first level than the second level, the data driving part determines that the level of the second recovery timing control signal is the first level, and when the level of the second recovery timing control signal is closer to the second level than the first level, the data driving part determines that the level of the second recovery timing control signal is the second level.

In an exemplary embodiment, the display panel driving apparatus further includes a comparator configured to compare the second recovery timing control signal with a reference voltage to output a third recovery timing control signal.

In an exemplary embodiment, the first recovery timing control signal transits from a first level to a second level different from the first level or transits from the second level to the first level, where the reference voltage has a medium value of the first level and the second level, and when a level of the second recovery timing control signal is closer to the first level than the reference voltage, a level of the third recovery timing control signal is the first level, and when the level of the second recovery timing control signal is closer to the second level than the reference voltage, the level of the third recovery timing control signal is the second level.

In an exemplary embodiment, the display panel driving apparatus further includes a detecting circuit configured to detect whether distortion is present in the first recovery timing control signal.

In an exemplary embodiment, the root mean square calculating part and the comparing part are included within the data driving part.

In an exemplary embodiment, the root mean square calculating part is included within the data driver.

In an exemplary embodiment, the data driving part recovers the clock signal from the display signal during a vertical blank period when the data signal is not output to the data line.

In an exemplary embodiment, the data driver includes a clock recovering part (e.g., a first circuit) configured to recover the clock signal from the display signal, and a data recovering part (e.g., a second circuit) configured to recover the image data from the display signal according to the clock signal.

According to an exemplary embodiment of the present inventive concept, a method of driving a display panel includes receiving a first recovery timing control signal for controlling a recovery of a clock signal from a display signal including image data and the clock signal, calculating a root mean square of the first recovery timing control signal to output a second recovery timing control signal, recovering the clock signal from the display signal according to the second recovery timing control signal, recovering the image data from the display signal according to the clock signal, outputting a data signal based on the image data to a data line of a display panel, and outputting a gate signal to a gate line of the display panel.

In an exemplary embodiment, the method furthers include detecting whether distortion is present in the first recovery timing control signal, and the outputting the second recovery timing control signal includes calculating the root mean square of the first recovery timing control signal while the distortion is present in the first recovery timing control signal.

In an exemplary embodiment, the method may further include comparing the second recovery timing control signal with a reference voltage to output a third recovery timing control signal, and recovering the clock signal from the display signal according to the third recovery timing control signal.

According to an exemplary embodiment of the present inventive concept, a display apparatus includes a display panel and a display panel driving apparatus. The display panel includes a gate line, a data line and a pixel electrode electrically connected to the gate line and the data line. The display panel driving apparatus includes a control circuit configured to receive a first recovery timing control signal for recovering a clock signal from a display signal including image data and the clock signal, calculate a root mean square of the first recovery timing control signal to output a second recovery timing control signal, a data driver configured to receive the display signal, receive the second recovery timing control signal from the control circuit, recover the clock signal from the display signal according to the second recovery timing control signal, and output a data signal based on the image data to the data line of the display panel, and a gate driver configured to output a gate signal to the gate line of the display panel.

In an exemplary embodiment, the first recovery timing control signal transits from a first level to a second level different from the first level or transits from the second level to the first level, and when a level of the second recovery timing control signal is closer to the first level rather than the second level, the data driver determines that the level of the second recovery timing control signal is the first level, and when the level of the second recovery timing control signal is closer to the second level than the first level, the data driver determines that the level of the second recovery timing control signal is the second level.

In an exemplary embodiment, the display panel driving apparatus further includes a comparator configured to compare the second recovery timing control signal with a reference voltage and output a third recovery timing control signal.

In an exemplary embodiment, the first recovery timing control signal transits from a first level to a second level different from the first level or transits from the second level to the first level, the reference voltage has a medium value of the first level and the second level, and when a level of the second recovery timing control signal is closer to the first level than the reference voltage, a level of the third recovery timing control signal is the first level, and when the level of the second recovery timing control signal is closer to the second level than the reference voltage, the level of the third recovery timing control signal is the second level.

According to an exemplary embodiment of the inventive concept, a display panel driving apparatus is provided that includes a detecting circuit, a control circuit, and a data driver. The detecting circuit is configured to detect whether distortion is present in a first control signal configured to be used to recover a clock signal from a display signal including the clock signal and image data. The control circuit is configured to output a second control signal having a level substantially the same as a level of the first control signal when the distortion is not present, and output a second control signal having a root mean square of the first control signal when the distortion is present. The data driver is configured to receive the display signal, receive the second control signal, recover the clock signal from the display panel according to the second control signal, and recover the image data according to the second control signal.

In an embodiment, the detecting circuit detects the distortion when the first control signal swings at least one during a given period of time.

In an embodiment, the data driver outputs a data signal based on the image data during a frame period, the data drier does not output the data signal during a vertical blank period different from the frame period, and the detecting circuit only performs the detect during the vertical blank period.

According to at least one embodiment of the present inventive concept, even when a distortion is present in a recovery timing control signal for recovering a clock signal from a display signal including image data and the clock signal, a data driver does not recognize the distortion of the recovery timing control signal. Therefore, an operation error of the data driving part may be prevented, and thus display quality of a display apparatus including the data driver may be improved.

BRIEF DESCRIPTION OF THE DRAWINGS

The inventive concept will become more apparent by describing in detail exemplary embodiments thereof with reference to the accompanying drawings, in which.

DETAILED DESCRIPTION OF THE EXEMPLARY EMBODIMENTS

Hereinafter, exemplary embodiments of the present inventive concept will be explained in detail with reference to the accompanying drawings.

Figure 1:
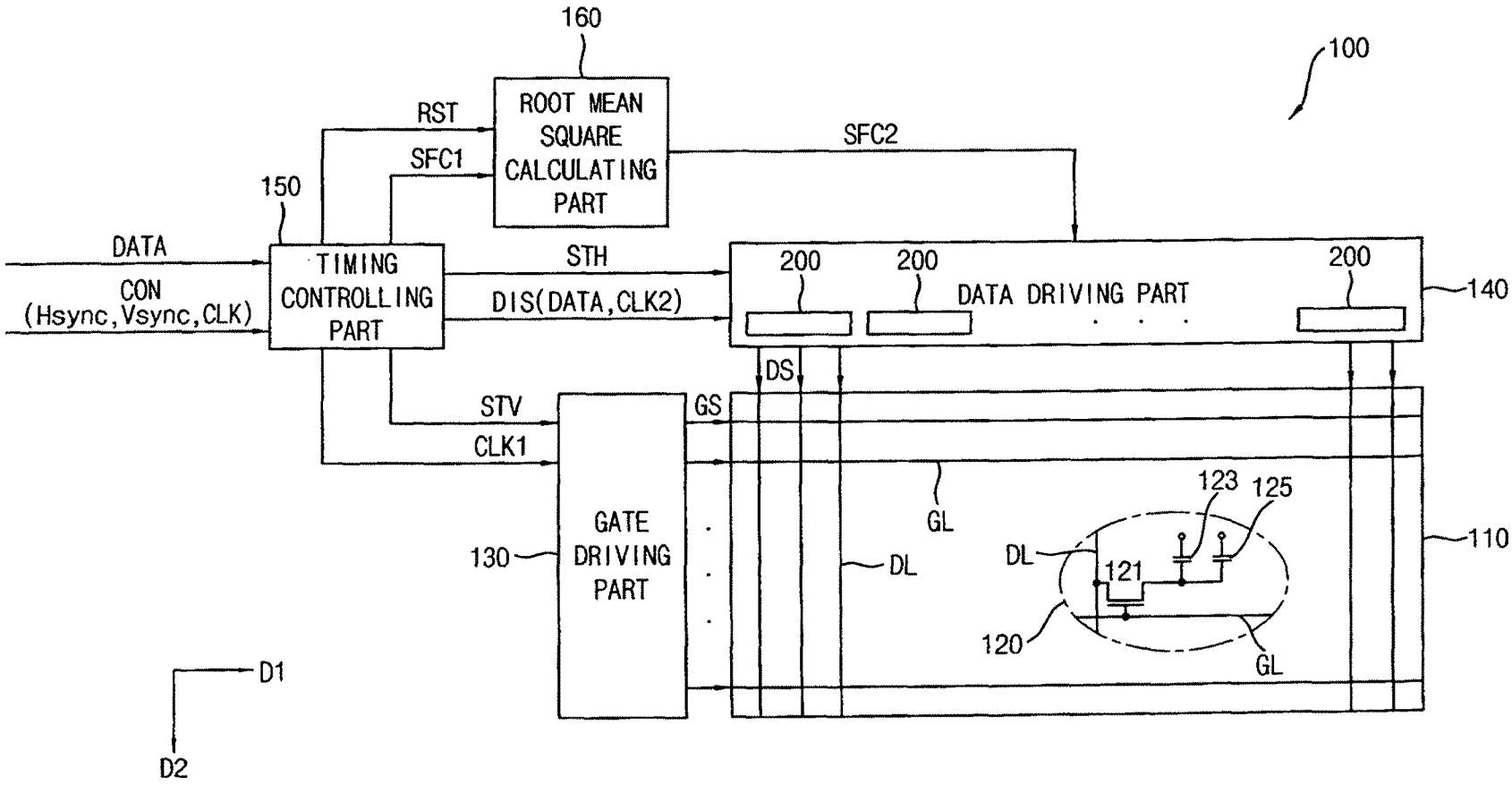
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130 (e.g., gate driver), a data driving part 140 (e.g., data driver), a timing controlling part 150 (e.g., a timing controller) and a root mean square (RMS) calculating part 160 (e.g., a control circuit configured to calculate an RMS).

The display panel 110 receives a data signal DS based on image data DATA provided from the timing controlling part 150 to display an image. For example, the image data DATA may be two-dimensional plane image data. Alternatively, the image data DATA may include left-eye image data and right-eye image data for displaying a three-dimensional stereoscopic image.

The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to the gate line GL and the data line DL, a liquid crystal capacitor 123 and a storage capacitor 125 connected to the thin film transistor 121.

The gate driving part 130, the data driving part 140, the timing controlling part 150 and the root mean square calculating part 160 may be part of a display panel driving apparatus driving the display panel 110.

The gate driving part 130 generates gate signals GS in response to a vertical start signal STV and a first clock signal CLK1 provided from the timing controlling part 150, and outputs the gate signals GS to the gate line GL.

The data driving part 140 outputs the data signals DS to the data lines DL in response to a horizontal start signal STH provided from the timing controlling part 150 and a second clock signal CLK2 included in a display signal DIS provided from the timing controlling part 150. The data driving part 140 may include at least one data driving integrated circuit part 200 outputting the data signals DS to the data lines DL.

The timing controlling part 150 receives the image data DATA and a control signal CON from an outside source. The control signal CON may include a horizontal synchronous signal Hsync, a vertical synchronous signal Vsync and a clock signal CLK.

The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140. Here, the timing controlling part 150 may output the display signal DIS including the image data DATA and the second clock signal CLK2 to the data driving part 140. For example, the display signal DIS may be a differential signal, and the second clock signal CLK2 may be embedded in the image data DATA.

The timing controlling part 150 outputs a first recovery timing control signal SFC1 and a root mean square time control signal RST to the root mean square calculating part 160. The first recovery timing control signal SFC1 is a signal for controlling a recovery timing when the data driving part 140 recovers the second clock signal CLK2 from the display signal DIS including the image data DATA and the second clock signal CLK2. For example, the state of the recovery timing control signal SFC1 can be used to determine whether to interpret a current section of the display signal DIS as image data or the second clock signal CLK2. Thus, the recovery timing control signal SFC1 can be used to recover or extract the second clock signal CLK2 or the image data from the display signal DIS. For example, when the first recovery timing control signal SFC1 is a first level which is a high level, the data driving part 140 may recover the second clock signal CLK2 from the display signal DIS. Alternatively, when the first recovery timing control signal SFC1 is a second level which is a low level, the data driving part 140 may recover the second clock signal CLK2 from the display signal DIS. Therefore, the first recovery timing control signal SFC1 may transit from the first level to the second level.

In addition, the first recovery timing control signal SFC1 may transit from the second level to the first level. The root mean square time control signal RST controls a period and a time when a root mean square of the first recovery timing control signal SFC1 is calculated.

The root mean square calculating part 160 receives the first recovery timing control signal SFC1 and the root mean square time control signal RST from the timing controlling part 150. The root mean square calculating part 160 calculates the root mean square of the first recovery timing control signal SFC1 to output a second recovery timing control signal SFC2. In an embodiment, the root mean square calculating part 160 calculates the root mean square of the first recovery timing control signal SFC1 every reference time according to the root mean square time control signal RST. For example, the root mean square calculating part 160 calculates the root mean square periodically.

Figure 2:
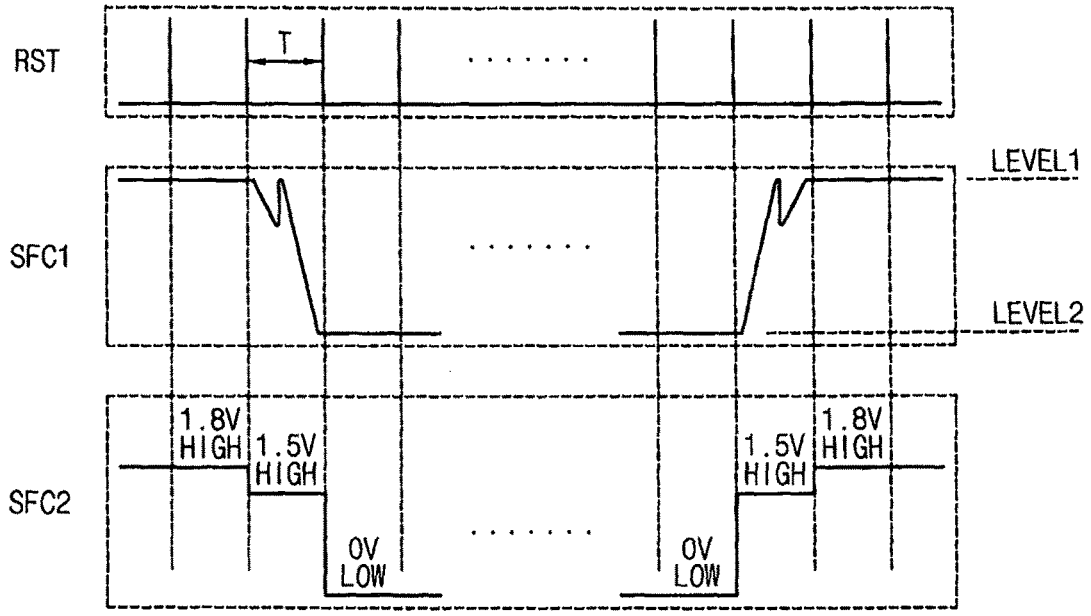
FIG. 2 is a waveforms diagram illustrating a root mean square time control signal, a first recovery timing control signal and a second recovery timing control signal.

FIG. 2 is a waveforms diagram illustrating the root mean square time control signal RST, the first recovery timing control signal SFC1 and the second recovery timing control signal SFC2.

Referring to FIGS. 1 and 2, the root mean square calculating part 160 calculates the root mean square of the first recovery timing control signal SFC1 every reference time T according to the root mean square time control signal RST to output the second recovery timing control signal SFC2. For example, if the reference time T is 100 ms, then the root mean square calculating part 160 would calculate a new root mean square every 100 ms while the root mean square time control signal RST is at a level that indicates a root mean square is to be calculated. For example, if the root mean square time control signal RST is at a low level for 1000 ms, the root mean square calculating part 160 would calculate 10 potentially different root mean squares.

The first recovery timing control signal SFC1 may transit from a first level LEVEL1 to a second level LEVEL2 different from the first level LEVEL1. In addition, the first recovery timing control signal SFC1 may transit from the second level LEVEL2 to the first level LEVEL1. For example, the first level LEVEL1 may be about 1.8 volt, and the second level LEVEL2 may be about 0 volt. Thus, the first level LEVEL1 may be a high level and the second level LEVEL2 may be a low level.

A distortion, glitch, or spike may occur in the first recovery timing control signal SFC1. Therefore, the first recovery timing control signal SFC1 may swing between the first level LEVEL1 and the second level LEVEL2 in the reference time T, or a glitch may occur in the first recovery timing control signal SFC1. For example, the distortion of the first recovery timing control signal SFC1 may occur due to a coupling or an impedance mismatching between a line through which the first recovery timing control signal SFC1 is transferred and another line (i.e., a line in which a signal other than the first recovery timing control signal SFC1 is transferred). In addition, the distortion of the first recovery timing control signal SFC1 may occur due to instability of power.

The root mean square calculating part 160 calculates the root mean square of the first recovery timing control signal SFC1 every reference time T to output the second recovery timing control signal SFC2. Therefore, the second recovery timing control signal SFC2 refers to the root mean square of the first recovery timing control signal SFC1. Thus, even when distortion is included in the first recovery timing control signal SFC1, the second recovery timing control signal SFC2 may have a constant current or voltage level every reference time T. For example, as shown in FIG. 2, a level of the second recovery timing control signal SFC2 may be about 1.5 volt every reference time T when the distortion is generated in the first recovery timing control signal SFC1.

The data driving part 140 determines that the level of the second recovery timing control signal SFC2 is the first level LEVEL1 when the level of the second recovery timing control signal SFC2 is close to the first level LEVEL1 rather than the second level LEVEL2. For example, the data driving part 140 determines that the level of the second recovery timing control signal SFC2 is the first level LEVEL1 when the level of the second recovery timing control signal SFC2 is closer to the first level LEVEL1 than the second level LEVEL2. In addition, the data driving part 140 determines that the level of the second recovery timing control signal SFC2 is the second level LEVEL2 when the level of the second recovery timing control signal SFC2 is close to the second level LEVEL2 rather than the first level LEVEL1. For example, the data driving part 140 determines that the level of the second recovery timing control signal SFC2 is the second level LEVEL2 when the level of the second recovery timing control signal SFC2 is closer to the second level LEVEL2 than the first level LEVEL1.

For the below examples, it is assumed that the first level LEVEL1 indicates that the second clock signal CLK2 is to be recovered and the second level LEVEL2 indicates the image data is to be recovered. If the level of the second recovery timing control signal SFC2 is within a threshold of the first level LEVEL1, the second recovery timing control signal SFC2 can be treated as indicating that recovery of the second clock signal CLK2 is to occur. For example, if the threshold is 0.5 volts, and the level of the second recovery timing control signal SFC2 is 1.5 volts as shown in FIG. 2, since 1.5 volts is within 0.5 volts of 1.8 volts, the second recovery timing control signal SFC2 can be treated as indicating that the second clock signal CLK2 is to be recovered. If the level of the second recovery timing control signal SFC2 is within a threshold of the second level LEVEL2, the second recovery timing control signal SFC2 can be treated as indicating that recovery of the image data is to occur.

Figure 3:
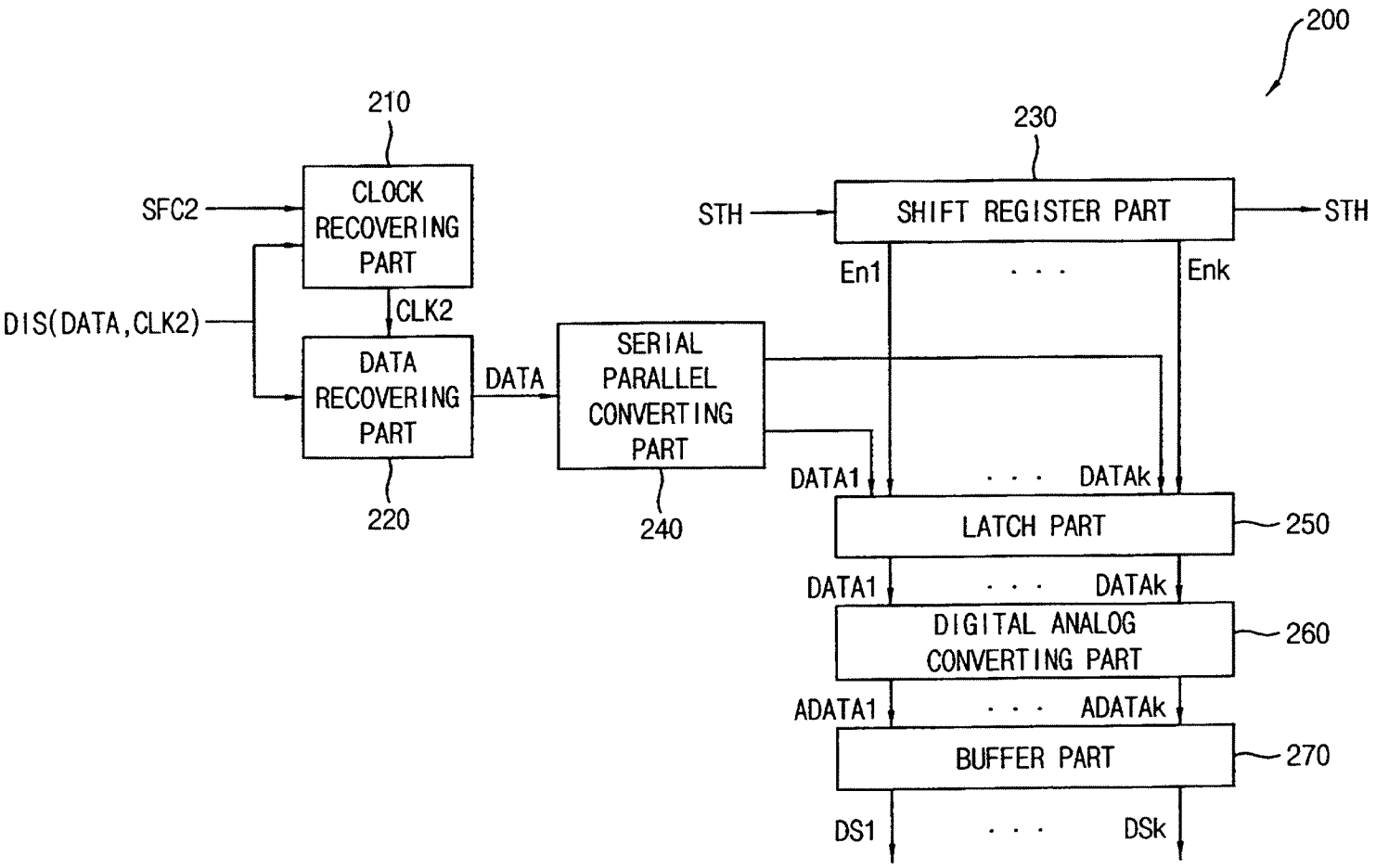
FIG. 3 is a block diagram illustrating a data driving circuit part of FIG. 1.

FIG. 3 is a block diagram illustrating the data driving circuit part 200 of FIG. 1 according to an exemplary embodiment of the inventive concept.

Referring to FIGS. 1 to 3, the data driving circuit part 200 includes a clock recovering part 210, a data recovering part 220, a shift register part 230, a serial parallel recovering part 240 (e.g., a circuit), a latch part 250 (e.g., a latch), a digital analog converting part 260 (e.g., a digital to analog converter) and a buffer part 270 (e.g., a buffer such as one or more OP-AMPs).

The clock recovering part 210 recovers the second clock signal CLK2 from the display signal DIS including the image data DATA and the second clock signal CLK2. Specifically, the clock recovering part 210 recovers the second clock signal CLK2 from the display signal DIS according to the second recovery timing control signal SFC2 during a vertical blank period when the data driving part 140 does not output the data signal DS to the data lines DL. The data driving part 140 outputs the data signal DS to the data lines DL during a frame period different from the vertical blank period. For example, the second recovery timing control signal SFC2 may have a low level during the vertical blank period. Alternatively, the second recovery timing control signal SFC2 may have a high level during the vertical blank period. The clock recovering part 210 may include a Phase Locked Loop (PLL) circuit or a Delay Locked Loop (DLL) circuit in order to recover the second clock signal CLK2 from the display signal DIS.

The clock recovering part 210 may determine that the level of the second recovery timing control signal SFC2 is the first level LEVEL1 which is the high level when the level of the second recovery timing control signal SFC2 is close to the first level LEVEL1 which is the high level rather than the second level LEVEL2 which is the low level. In addition, the clock recovering part 210 may determine that the level of the second recovery timing control signal SFC2 is the second level LEVEL2 which is the low level when the level of the second recovery timing control signal SFC2 is close to the second level LEVEL2 which is the low level rather than the first level LEVEL1 which is the high level. The clock recovering part 210 recovers the second clock signal CLK2 from the display signal DIS and outputs the second clock signal CLK2 to the data recovering part 220. For example, when the first level LEVEL1 indicates the second clock signal CLK2 is to be recovered, and the level of the second recovery timing control signal SFC2 is within a threshold of the first level LEVEL1, the clock recovering part 210 recovers the second clock signal CLK2 from the display signal DIS.

The data recovering part 220 recovers the image data DATA from the display signal DIS according to the second clock signal CLK2 received from the clock recovering part 210. The data recovering part 220 outputs the image data DATA to the serial parallel converting part 240. For example, when the second level LEVEL2 indicates the image data is to be recovered, and the level of the second recovery timing control signal SFC2 is within a threshold of the second level LEVEL2, the data recovering part 220 image DATA from the display signal DIS.

The serial parallel converting part 240 (e.g., a serial to parallel converter) receives the image data DATA from the data recovering part 220, and converts the image data DATA into parallel data DATA1 to DATAk to output the parallel data DATA1 to DATAk.

The shift register part 230 (e.g., shift register) shifts the horizontal start signal STH to generate enable signals En1 to Enk, and provides the enable signals En1 to Enk to the latch part 250. The serial parallel converting part 240 provides the parallel data DATA1 to DATAk to the latch part 250. The enable signals En1 to Enk are used to control the latch part 250 to latch and output the parallel data DATA1 to DATAk with a particular timing, The latch part 250 stores the parallel data DATA1 to DATAk, and outputs the parallel data DATA1 to DATAk to the digital analog converting part 260.

The digital analog converting part 260 receives the parallel data DATA1 to DATAk from the latch part 250, and converts the parallel data DATA1 into DATAk to analog data ADATA1 to ADATAk to output the analog data ADATA1 to ADATAk to the buffer part 270.

The buffer part 270 outputs data signals DS1 to DSk to the data lines DL of the display panel 110. Here, the data signals DS1 to DSk may be included in the data signals DS of FIG. 1.

Figure 4:
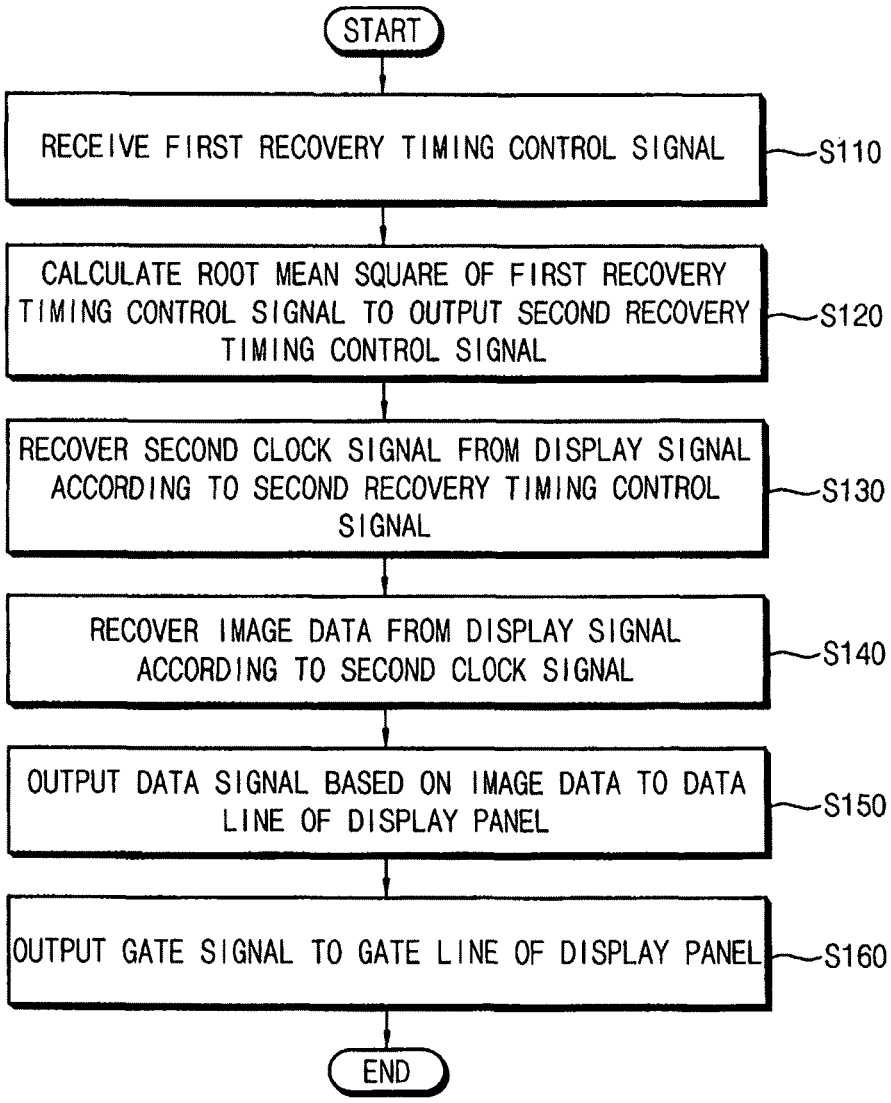
FIG. 4 is a flow chart illustrating a method of driving a display panel performed by a display panel driving apparatus of FIG. 1 according to an exemplary embodiment of the present inventive concept.

FIG. 4 is a flow chart illustrating a method of driving a display panel performed by the display panel driving apparatus of FIG. 1 according to an exemplary embodiment of the inventive concept.

Referring to FIGS. 1 to 4, the first recovery timing control signal SFC1 is received (step S110). Specifically, the root mean square calculating part 160 receives the first recovery timing control signal SFC1 from the timing controlling part 150.

The root mean square of the first recovery timing control signal SFC1 is calculated and the second recovery timing control signal SFC2 is output (step S120).

Specifically, the root mean square calculating part 160 calculates the root mean square of the first recovery timing control signal SFC1 to output the second recovery timing control signal SFC2. The root mean square calculating part 160 may calculate the root mean square of the first recovery timing control signal SFC1 every reference time T according to the root mean square time control signal RST. Even when the distortion is included in the first recovery timing control signal SFC1, the second recovery timing control signal SFC2 may have constant current or voltage level every reference time T.

The second clock signal CLK2 is recovered from the display signal DIS according to the second recovery timing control signal SFC2 (step S130). Specifically, the clock recovering part 210 recovers the second clock signal CLK2 from the display signal DIS including the image data DATA and the second clock signal CLK2. The clock recovering part 210 recovers the second clock signal CLK2 from the display signal DIS according to the second recovery timing control signal SFC2 during the vertical blank period when the data driving part 140 does not output the data signal DS to the data lines DL. For example, a period when the second recovery timing control signal SFC2 is a low level may be the vertical blank period. Alternatively, a period when the second recovery timing control signal SFC2 is a high level may be the vertical blank period.

The clock recovering part 210 may determine that the level of the second recovery timing control signal SFC2 is the first level LEVEL1 which is the high level when the level of the second recovery timing control signal SFC2 is close to the first level LEVEL1 which is the high level rather than the second level LEVEL2 which is the low level. In addition, the clock recovering part 210 may determine that the level of the second recovery timing control signal SFC2 is the second level LEVEL2 which is the low level when the level of the second recovery timing control signal SFC2 is close to the second level LEVEL2 which is the low level rather than the first level LEVEL1 which is the high level. The clock recovering part 210 recovers the second clock signal CLK2 from the display signal DIS and outputs the second clock signal CLK2 to the data recovering part 220.

The image data DATA is recovered from the display signal DIS according to the second clock signal CLK2 (step S140). Specifically, the data recovering part 220 recovers the image data DATA from the display signal DIS according to the second clock signal CLK2 received from the clock recovering part 210. The data recovering part 220 outputs the image data DATA to the serial parallel converting part 240.

The data signal DS based on the image data DATA is output to the data lines DL of the display panel 110 (step S150). Specifically, the serial parallel converting part 240 receives the image data DATA from the data recovering part 220, and converts the image data DATA into the parallel data DATA1 to DATAk to output the parallel data DATA1 to DATAk. The shift register part 230 shifts the horizontal start signal STH to generate enable signals En1 to Enk, and provides the enable signals En1 to Enk to the latch part 250. The serial parallel converting part 240 provides the parallel data DATA1 to DATAk to the latch part 250. The latch part 250 stores the parallel data DATA1 to DATAk, and outputs the parallel data the DATA1 to DATAk to the digital analog converting part 260.

The digital analog converting part 260 receives the parallel data DATA1 to DATAk from the latch part 250, and converts the parallel data DATA1 to DATAk to the analog data ADATA1 to ADATAk to output the analog data ADATA1 to ADATAk to the buffer part 270. The buffer part 270 outputs the data signals DS1 to DSk to the data lines DL of the display panel 110. Here, the data signals DS1 to DSk may be included in the data signals DS of FIG. 1.

The gate signal GS is output to the gate line GL of the display panel 110 (step S160). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, the data driving part 140 recovers the second clock signal CLK2 from the display signal DIS according to the second recovery timing control signal SFC2 which is the root mean square of the first recovery timing control signal SFC1. Therefore, although the distortion is included in the first recovery timing control signal SFC1, the data driving part 140 does not recognize the distortion of the first recovery timing control signal SFC1. Thus, an error in which the data driving part 140 recognizes a high level of the first recovery timing control signal SFC1 as a low level or recognizes a low level of the first recovery timing control signal SFC1 as a high level may be prevented. Therefore, an operation error of the data driving part 140 may be prevented, and thus display quality of the display apparatus 100 may be improved.

Figure 5:
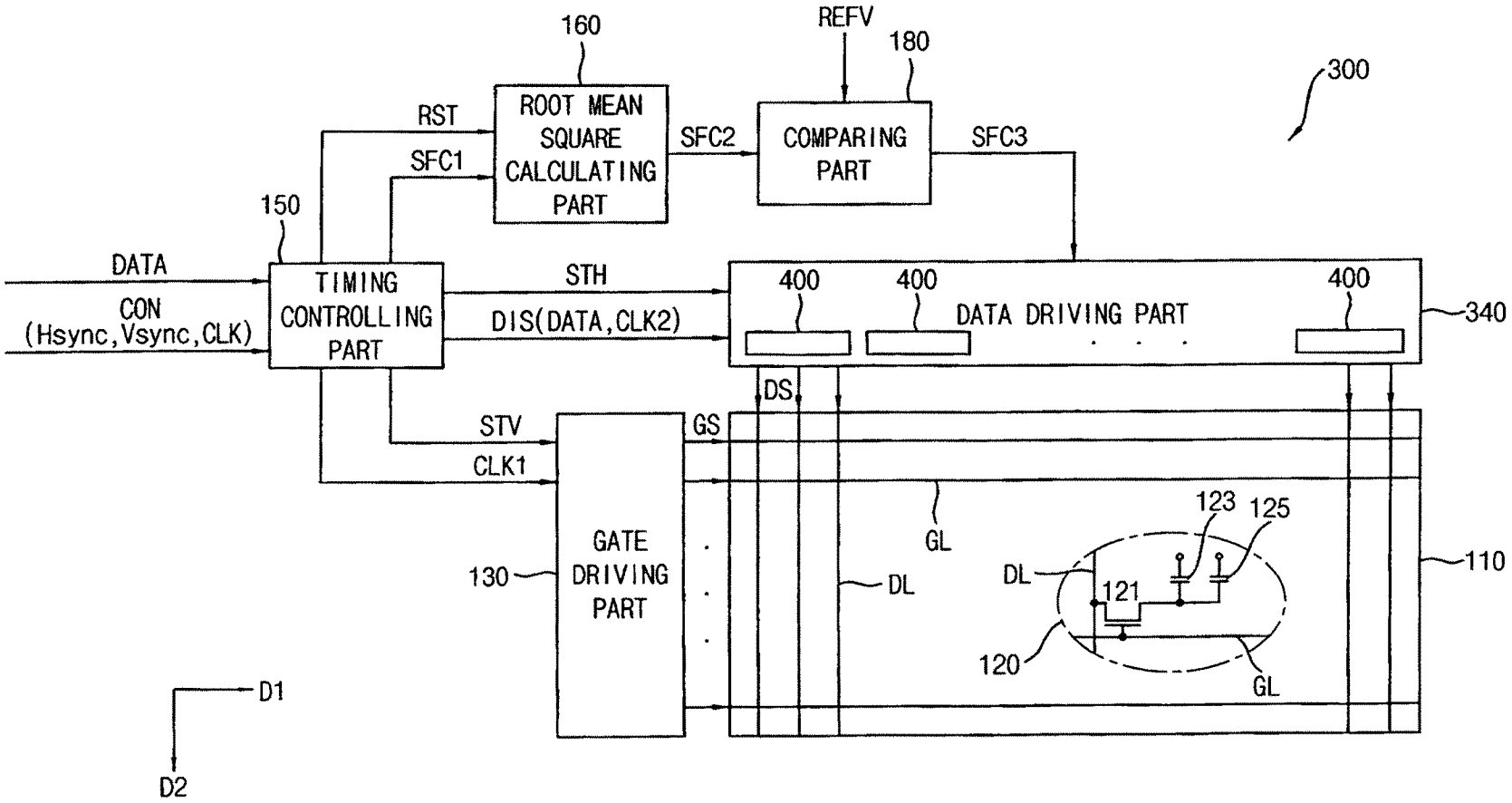
FIG. 5 is a block diagram illustrating a display apparatus according to an exemplary embodiment of the present inventive concept.

FIG. 5 is a block diagram illustrating a display apparatus according to an exemplary embodiment of the present inventive concept.

The display apparatus 300 according to the present exemplary embodiment is substantially the same as the display apparatus 100 according to the previous exemplary embodiment illustrated in FIG. 1 except for a data driving part 340 and a comparing part 180 (e.g., a comparator). Thus, the same reference numerals will be used to refer to same or like parts as those described in the previous exemplary embodiment and any further repetitive explanation concerning the above elements will be omitted.

Referring to FIG. 5, the display apparatus 300 according to the present exemplary embodiment includes the display panel 110, the gate driving part 130, the data driving part 340, the timing controlling part 150, the root mean square calculating part 160 and the comparing part 180.

The gate driving part 130, the data driving part 340, the timing controlling part 150, the root mean square calculating part 160 and the comparing part 180 may be part of a display panel driving apparatus driving the display panel 110.

The data driving part 340 outputs the data signals DS to the data lines DL in response to the horizontal start signal STH provided from the timing controlling part 150 and the second clock signal CLK2 included in the display signal DIS provided from the timing controlling part 150. The data driving part 340 may include at least one data driving integrated circuit part 400 outputting the data signals DS to the data lines DL.

The timing controlling part 150 outputs the first recovery timing control signal SFC1 and the root mean square time control signal RST to the root mean square calculating part 160. The first recovery timing control signal SFC1 may be a signal for controlling a recovery timing when the data driving part 340 recovers the second clock signal CLK2 from the display signal DIS including the image data DATA and the second clock signal CLK2. For example, when the first recovery timing control signal SFC1 is a first level which is a high level, the data driving part 340 may recover the second clock signal CLK2 from the display signal DIS. Alternatively, when the first recovery timing control signal SFC1 is a second level which is a low level, the data driving part 340 may recover the second clock signal CLK2 from the display signal DIS. Therefore, the first recovery timing control signal SFC1 may transit from the first level to the second level.

In addition, the first recovery timing control signal SFC1 may transit from the second level to the first level. The root mean square time control signal RST may control a period and a time when a root mean square of the first recovery timing control signal SFC1 is calculated.

The root mean square calculating part 160 receives the first recovery timing control signal SFC1 and the root mean square time control signal RST from the timing controlling part 150. The root mean square calculating part 160 calculates the root mean square of the first recovery timing control signal SFC1 to output the second recovery timing control signal SFC2. The root mean square calculating part 160 may calculate the root mean square of the first recovery timing control signal SFC1 every reference time according to the root mean square time control signal RST.

The comparing part 180 receives the second recovery timing control signal SFC2 from the root mean square calculating part 160, and receives a reference voltage REFV from an outside source.

Figure 6:
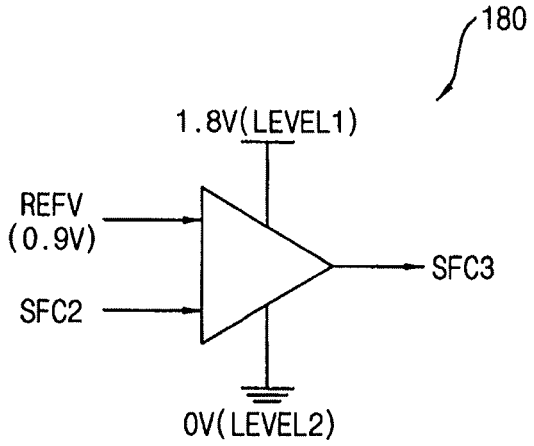
FIG. 6 is a circuit diagram illustrating a comparing part of FIG. 5.

FIG. 6 is a circuit diagram illustrating the comparing part 180 of FIG. 5 according to an exemplary embodiment of the inventive concept.

Referring to FIGS. 5 and 6, the comparing part 180 compares the second recovery timing control signal SFC2 with the reference voltage REFV to output a third recovery timing control signal SFC3. Specifically, when the level of the second recovery timing control signal SFC2 is not less than the reference voltage REFV, the third recovery timing control signal SFC3 has the first level LEVEL1. In addition, when the level of the second recovery timing control signal SFC2 is less than the reference voltage REFV, the third recovery timing control signal SFC3 has the second level LEVEL2.

Here, the first level LEVEL1 of the third recovery timing control signal SFC3 may correspond to a high level of the first recovery timing control signal SFC1 and the second level LEVEL2 of the third recovery timing control signal SFC3 may correspond to a low level of the first recovery timing control signal SFC1. For example, the first level LEVEL1 may be about 1.8 volt, the second level LEVEL2 may be about 0 volt, and the reference voltage REFV may be about 0.9 volt which is a medium value of the first level LEVEL1 and the second level LEVEL2. For example, the reference voltage REFV may be a voltage that is half way between the first level LEVEL1 and the second level LEVEL2, or an average voltage of the first level LEVEL1 and the second level LEVEL2.

Figure 7:
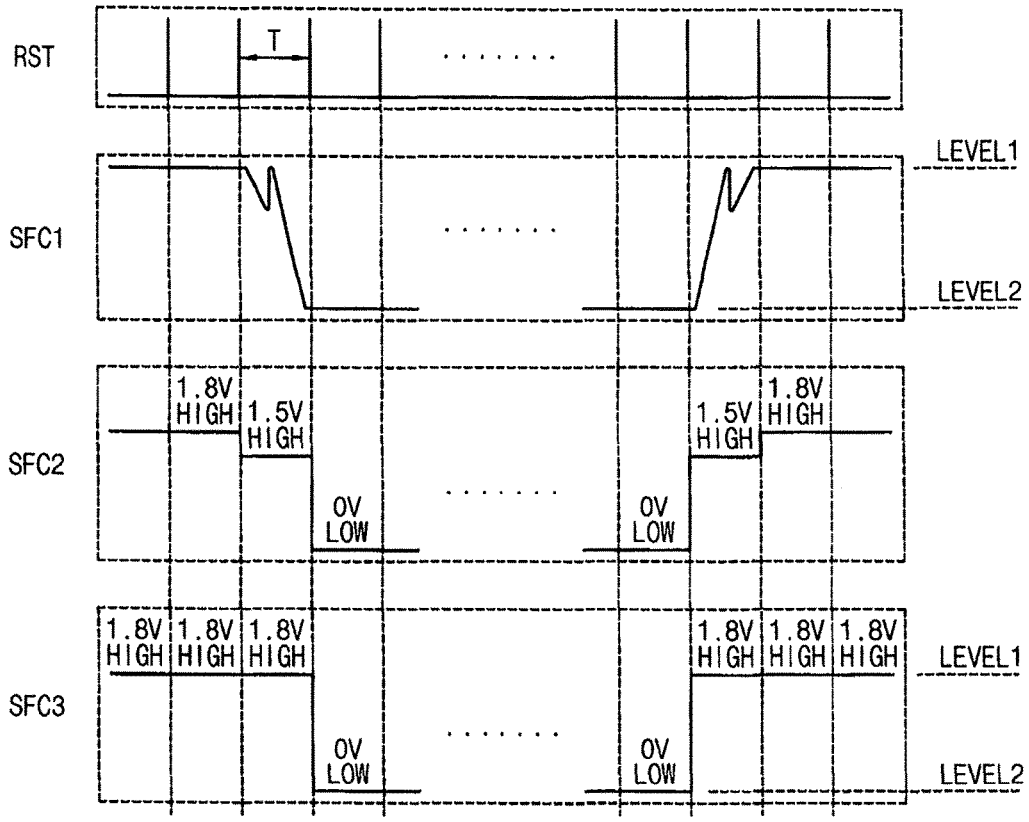
FIG. 7 is a waveforms diagram illustrating a root mean square time control signal, a first recovery timing control signal, a second recovery timing control signal and a third recovery timing control signal.

FIG. 7 is a waveforms diagram illustrating the root mean square time control signal RST, the first recovery timing control signal SFC1, the second recovery timing control signal SFC2 and the third recovery timing control signal SFC3.

Referring to FIGS. 5 to 7, the root mean square calculating part 160 calculates the root mean square of the first recovery timing control signal SFC1 every reference time T according to the root mean square time control signal RST to output the second recovery timing control signal SFC2.

Specifically, the first recovery timing control signal SFC1 may transit from the first level LEVEL1 to the second level LEVEL2 different from the first level LEVEL1. In addition, the first recovery timing control signal SFC1 may transit from the second level LEVEL2 to the first level LEVEL1. For example, the first level LEVEL1 may be about 1.8 volt, and the second level LEVEL2 may be about 0 volt. Thus, the first level LEVEL1 may be a high level and the second level LEVEL2 may be a low level.

A distortion may occur in the first recovery timing control signal SFC1.

Therefore, the first recovery timing control signal SFC1 may swing between the first level LEVEL1 and the second level LEVEL2 in the reference time T. For example, the distortion of the first recovery timing control signal SFC1 may occur due to a coupling or an impedance mismatching between a line through which the first recovery timing control signal SFC1 is transferred and another line (i.e., a line other than the line through which the first recovery timing control signal SFC1 is transferred). In addition, the distortion of the first recovery timing control signal SFC1 may occur due to instability of power.

The root mean square calculating part 160 calculates the root mean square of the first recovery timing control signal SFC1 every reference time T to output the second recovery timing control signal SFC2. Therefore, the second recovery timing control signal SFC2 refers to the root mean square of the first recovery timing control signal SFC1. Thus, even when the distortion is included in the first recovery timing control signal SFC1, the second recovery timing control signal SFC2 has a constant current or voltage level every reference time T. For example, as shown in FIG. 7, the level of the second recovery timing control signal SFC2 may be about 1.5 volt every reference time T when the distortion is generated in the first recovery timing control signal SFC1.

The comparing part 180 compares the second recovery timing control signal SFC2 with the reference voltage REFV to output the third recovery timing control signal SFC3. Thus, when the level of the second recovery timing control signal SFC2 is not less than the reference voltage REFV, the third recovery timing control signal SFC3 has the first level LEVEL1. In addition, when the level of the second recovery timing control signal SFC2 is less than the reference voltage REFV, the third recovery timing control signal SFC3 has the second level LEVEL2.

Figure 8:
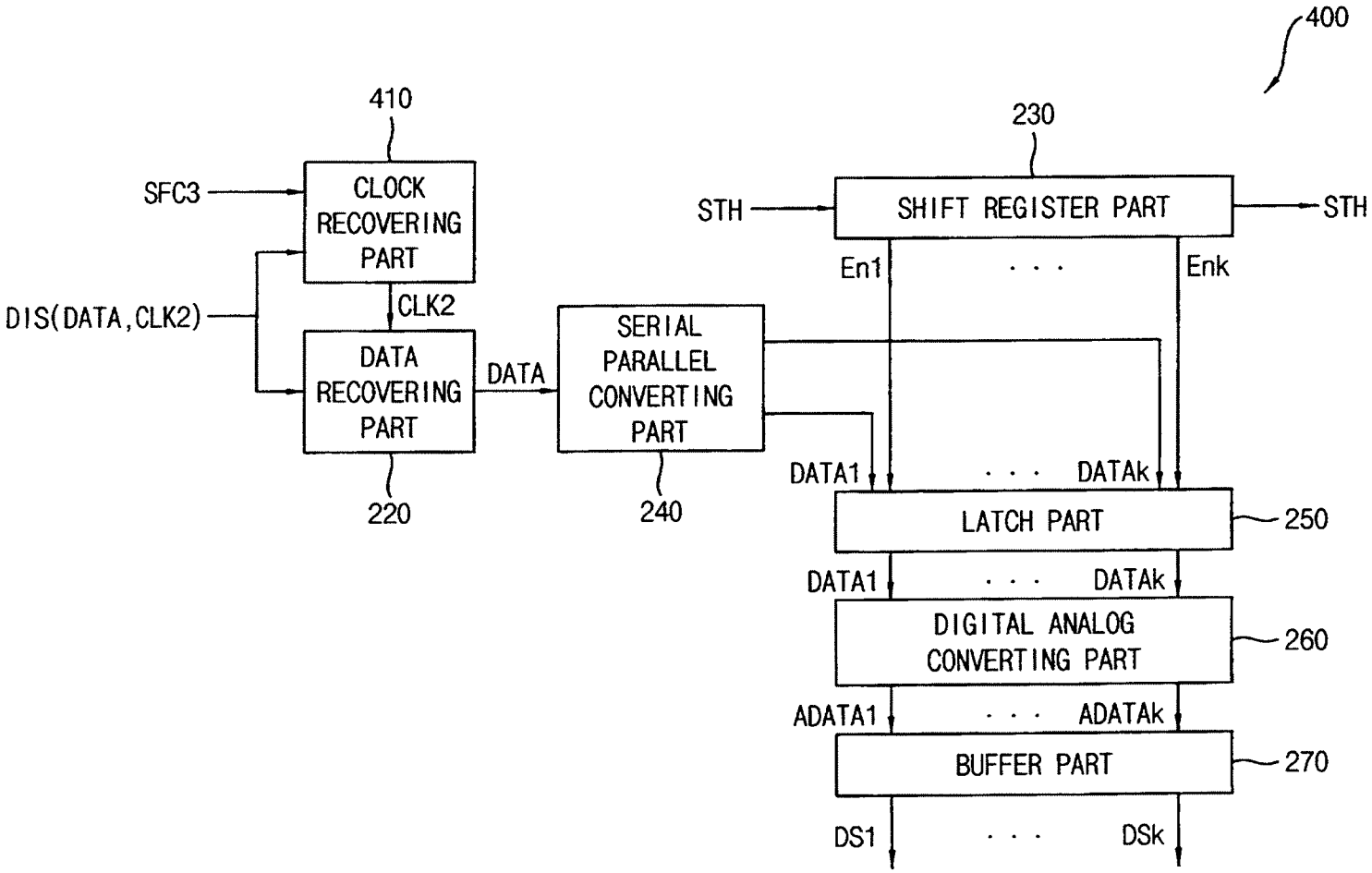
FIG. 8 is a block diagram illustrating a data driving circuit part of FIG. 5.

FIG. 8 is a block diagram illustrating the data driving circuit part 400 of FIG. 5 according to an exemplary embodiment of the inventive concept.

Referring to FIGS. 5, 7 and 8, the data driving circuit part 400 includes a clock recovering part 410, the data recovering part 220, the shift register part 230, the serial parallel converting part 240, the latch part 250, the digital analog converting part 260 and the buffer part 270.

The clock recovering part 410 recovers the second clock signal CLK2 from the display signal DIS including the image data DATA and the second clock signal CLK2.

Specifically, the clock recovering part 410 recovers the second clock signal CLK2 from the display signal DIS according to the third recovery timing control signal SFC3 during a vertical blank period when the data driving part 340 does not output the data signal DS to the data lines DL. For example, the third recovery timing control signal SFC3 may have a low level during the vertical blank period. Alternatively, the third recovery timing control signal SFC3 may have a high level during the vertical blank period. The clock recovering part 410 may include a Phase Locked Loop (PLL) circuit or a Delay Locked Loop (DLL) circuit in order to recover the second clock signal CLK2 from the display signal DIS.

The clock recovering part 410 determine that the level of the third recovery timing control signal SFC3 is the first level LEVEL1 which is the high level when the level of the third recovery timing control signal SFC3 is close to the first level LEVEL1 which is the high level rather than the second level LEVEL2 which is the low level. In addition, the clock recovering part 410 may determine that the level of the second recovery timing control signal SFC3 is the second level LEVEL2 which is the low level when the level of the second recovery timing control signal SFC3 is close to the second level LEVEL2 which is the low level rather than the first level LEVEL1 which is the high level. The clock recovering part 410 recovers the second clock signal CLK2 from the display signal DIS and outputs the second clock signal CLK2 to the data recovering part 220.

The data recovering part 220 recovers the image data DATA from the display signal DIS according to the second clock signal CLK2 received from the clock recovering part 410. The data recovering part 220 outputs the image data DATA to the serial parallel converting part 240. The serial parallel converting part 240 receives the image data DATA from the data recovering part 220, and converts the image data DATA into the parallel data DATA1 to DATAk to output the parallel data DATA1 to DATAk.

The shift register part 230 shifts the horizontal start signal STH to generate enable signals En1 to Enk, and provides the enable signals En1 to Enk to the latch part 250. The serial parallel converting part 340 provides the parallel data DATA1 to DATAk to the latch part 250. The latch part 250 stores the parallel data DATA1 to DATAk, and outputs the parallel data DATA1 to DATAk to the digital analog converting part 260. The digital analog converting part 260 receives the parallel data DATA1 to DATAk from the latch part 250, and converts the parallel data DATA1 to DATAk into the analog data ADATA1 to ADATAk to output the analog data ADATA1 to ADATAk to the buffer part 270. The buffer part 270 outputs the data signals DS1 to DSk to the data lines DL of the display panel 110. Here, the data signals DS1 to DSk may be included in the data signals DS of FIG. 1.

Figure 9:
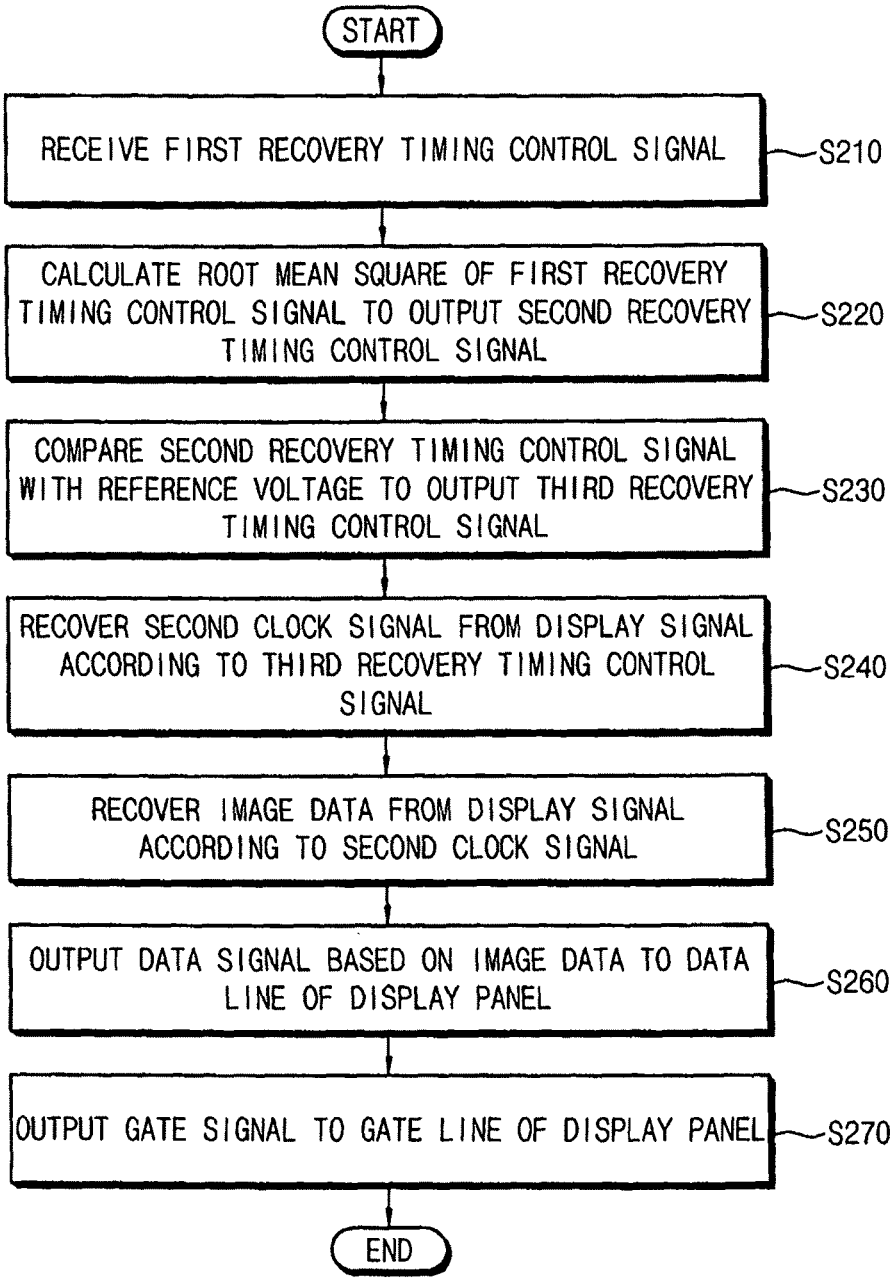
FIG. 9 is a flow chart illustrating a method of driving a display panel performed by a display panel driving apparatus of FIG. 5.

FIG. 9 is a flow chart illustrating a method of driving a display panel performed by the display panel driving apparatus of FIG. 5 according to an exemplary embodiment of the inventive concept.

Referring to FIGS. 5 to 9, the first recovery timing control signal SFC1 is received (step S210). Specifically, the root mean square calculating part 160 receives the first recovery timing control signal SFC1 from the timing controlling part 150.

The root mean square of the first recovery timing control signal SFC1 is calculated and the second recovery timing control signal SFC2 is output (step S220).

Specifically, the root mean square calculating part 160 calculates the root mean square of the first recovery timing control signal SFC1 to output the second recovery timing control signal SFC2. The root mean square calculating part 160 may calculate the root mean square of the first recovery timing control signal SFC1 every reference time T according to the root mean square time control signal RST. Thus, even when distortion is included in the first recovery timing control signal SFC1, the second recovery timing control signal SFC2 may have a constant current or voltage level every reference time T.

The second recovery timing control signal SFC2 is compared with the reference voltage REFV to output the third recovery timing control signal SFC3 (step S230). Specifically, the comparing part 180 compares the second recovery timing control signal SFC2 with the reference voltage REFV to output the third recovery timing control signal SFC3. Thus, when the level of the second recovery timing control signal SFC2 is not less than the reference voltage REFV, the third recovery timing control signal SFC3 has the first level LEVEL1. In addition, when the level of the second recovery timing control signal SFC2 is less than the reference voltage REFV, the third recovery timing control signal SFC3 has the second level LEVEL2.

The second clock signal CLK2 is recovered from the display signal DIS according to the third recovery timing control signal SFC3 (step S240). Specifically, the clock recovering part 210 recovers the second clock signal CLK2 from the display signal DIS including the image data DATA and the second clock signal CLK2. The clock recovering part 210 recovers the second clock signal CLK2 from the display signal DIS according to the third recovery timing control signal SFC3 during the vertical blank period when the data driving part 340 does not output the data signal DS to the data lines DL. For example, a period when the third recovery timing control signal SFC3 is a low level may be the vertical blank period. Alternatively, a period when the third recovery timing control signal SFC3 is a high level may be the vertical blank period. The clock recovering part 210 recovers the second clock signal CLK2 from the display signal DIS to output the second clock signal CLK2 to the data recovering part 220.

The image data DATA is recovered from the display signal DIS according to the second clock signal CLK2 (step S250). Specifically, the data recovering part 220 recovers the image data DATA from the display signal DIS according to the second clock signal CLK2 received from the clock recovering part 410. The data recovering part 220 outputs the image data DATA to the serial parallel converting part 240.

The data signal DS based on the image data DATA is output to the data lines DL of the display panel 110 (step S260). Specifically, the serial parallel converting part 240 receives the image data DATA from the data recovering part 220, and converts the image data DATA into the parallel data DATA1 to DATAk to output the parallel data DATA1 to DATAk. The shift register part 230 shifts the horizontal start signal STH to generate enable signals En1 to Enk, and provides the enable signals En1 to Enk to the latch part 250. The serial parallel converting part 240 provides the parallel data DATA1 to DATAk to the latch part 250. The latch part 250 stores the parallel data DATA1 to DATAk, and outputs the parallel data the DATA1 to DATAk to the digital analog converting part 260. The digital analog converting part 260 receives the parallel data DATA1 to DATAk from the latch part 250, and converts the parallel data DATA1 to DATAk into the analog data ADATA1 to ADATAk to output the analog data ADATA1 to ADATAk to the buffer part 270. The buffer part 270 outputs the data signals DS1 to DSk to the data lines DL of the display panel 110. Here, the data signals DS1 to DSk may be included in the data signals DS of FIG. 1.

The gate signal GS is output to the gate line GL of the display panel 110 (step S270). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, the data driving part 340 recovers the second clock signal CLK2 from the display signal DIS according to the third recovery timing control signal SFC3 having the first level LEVEL1 and the second level LEVEL2 based on the second recovery timing control signal SFC2 which is the root mean square of the first recovery timing control signal SFC1. Therefore, even when the distortion is included in the first recovery timing control signal SFC1, the data driving part 340 does not recognize the distortion of the first recovery timing control signal SFC1.

Thus, an error in which the data driving part 340 recognizes a high level of the first recovery timing control signal SFC1 as a low level or recognizes a low level of the first recovery timing control signal SFC1 as a high level may be prevented. Therefore, an operation error of the data driving part 340 may be prevented, and thus display quality of the display apparatus 300 may be improved.

Figure 10:
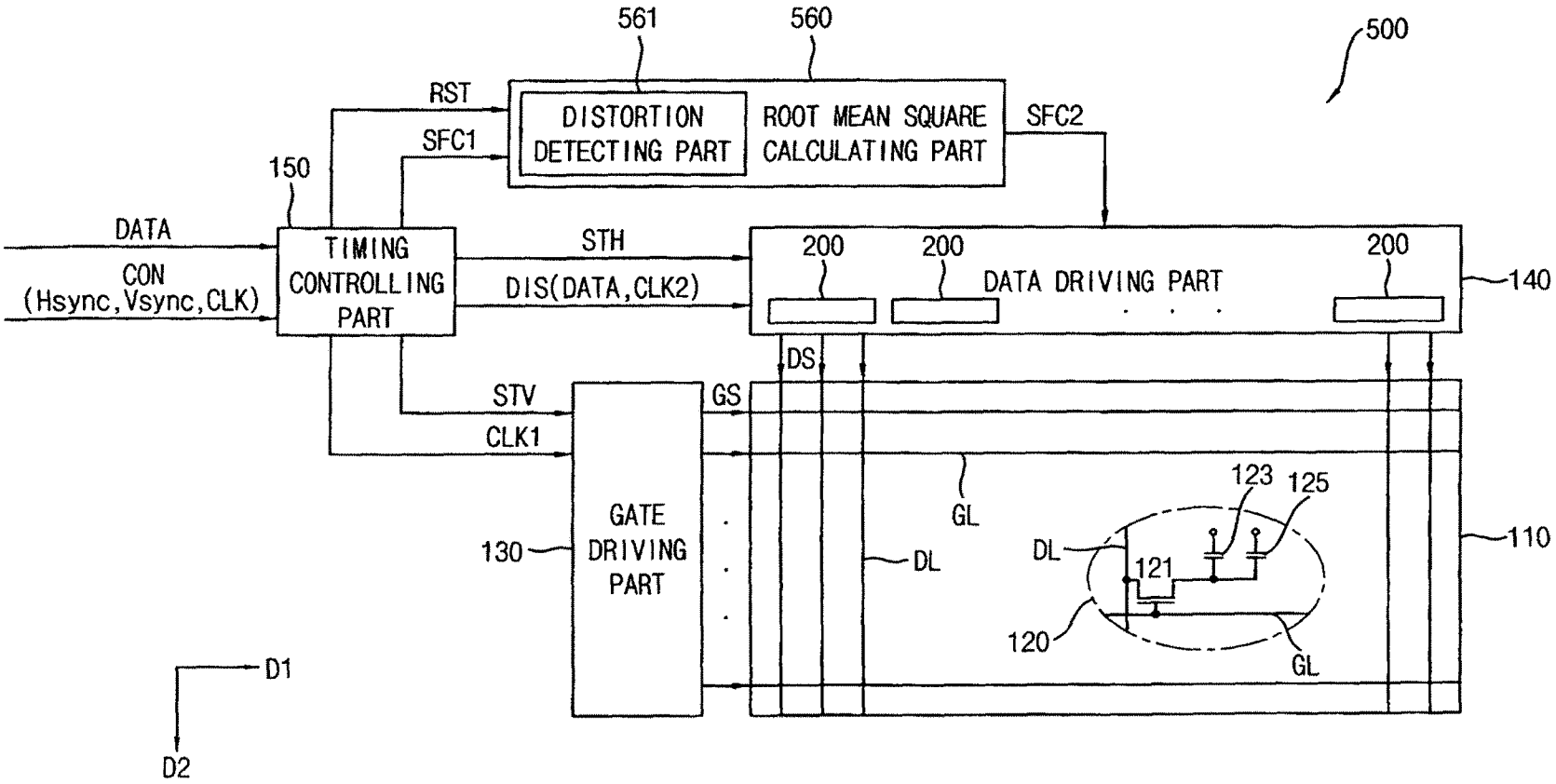
FIG. 10 is a block diagram illustrating a display apparatus according to an exemplary embodiment of the present inventive concept.

FIG. 10 is a block diagram illustrating a display apparatus according to an exemplary embodiment of the present inventive concept.

The display apparatus 500 according to the present exemplary embodiment is substantially the same as the display apparatus 100 according to the previous exemplary embodiment illustrated in FIG. 1 except for a root mean square calculating part 560. Thus, the same reference numerals will be used to refer to same or like parts as those described in the previous exemplary embodiment and any further repetitive explanation concerning the above elements will be omitted.

Referring to FIG. 10, the display apparatus 500 according to the present exemplary embodiment includes the display panel 110, the gate driving part 130, the data driving part 140, the timing controlling part 150 and the root mean square calculating part 560.

The gate driving part 130, the data driving part 140, the timing controlling part 150 and the root mean square calculating part 560 may be part of a display panel driving apparatus driving the display panel 110.

The root mean square calculating part 560 receives the first recovery timing control signal SFC1 and the root mean square time control signal RST from the timing controlling part 150. The root mean square calculating part 560 includes a distortion detecting part 561 (e.g., detecting circuit). The distortion detecting part 561 detects the distortion of the first recovery timing control signal SFC1. For example, the distortion detecting part 561 determines whether the first recovery timing control signal SFC1 swings at least once within a reference time or a glitch or spike is present in the first recovery timing control signal SFC1 every reference time defined in the root mean square time control signal RST.

The root mean square calculating part 560 outputs a second recovery timing control signal SFC2 having a level substantially the same as a level of the first recovery timing control signal SFC1 in a period when the distortion is not present in the first recovery timing control signal SFC1. The root mean square calculating part 560 outputs a second recovery timing control signal SFC2 having the root mean square of the first recovery timing control signal SFC1 in a period when the distortion is present in the first recovery timing control signal SFC1.

A waveforms diagram illustrating the root mean square time control signal RST, the first recovery timing control signal SFC1 and the second recovery timing control signal SFC2 of FIG. 10 is substantially the same as the waveforms diagram illustrating the root mean square time control signal RST, the first recovery timing control signal SFC1 and the second recovery timing control signal SFC2 of FIG. 2.

Figure 11:
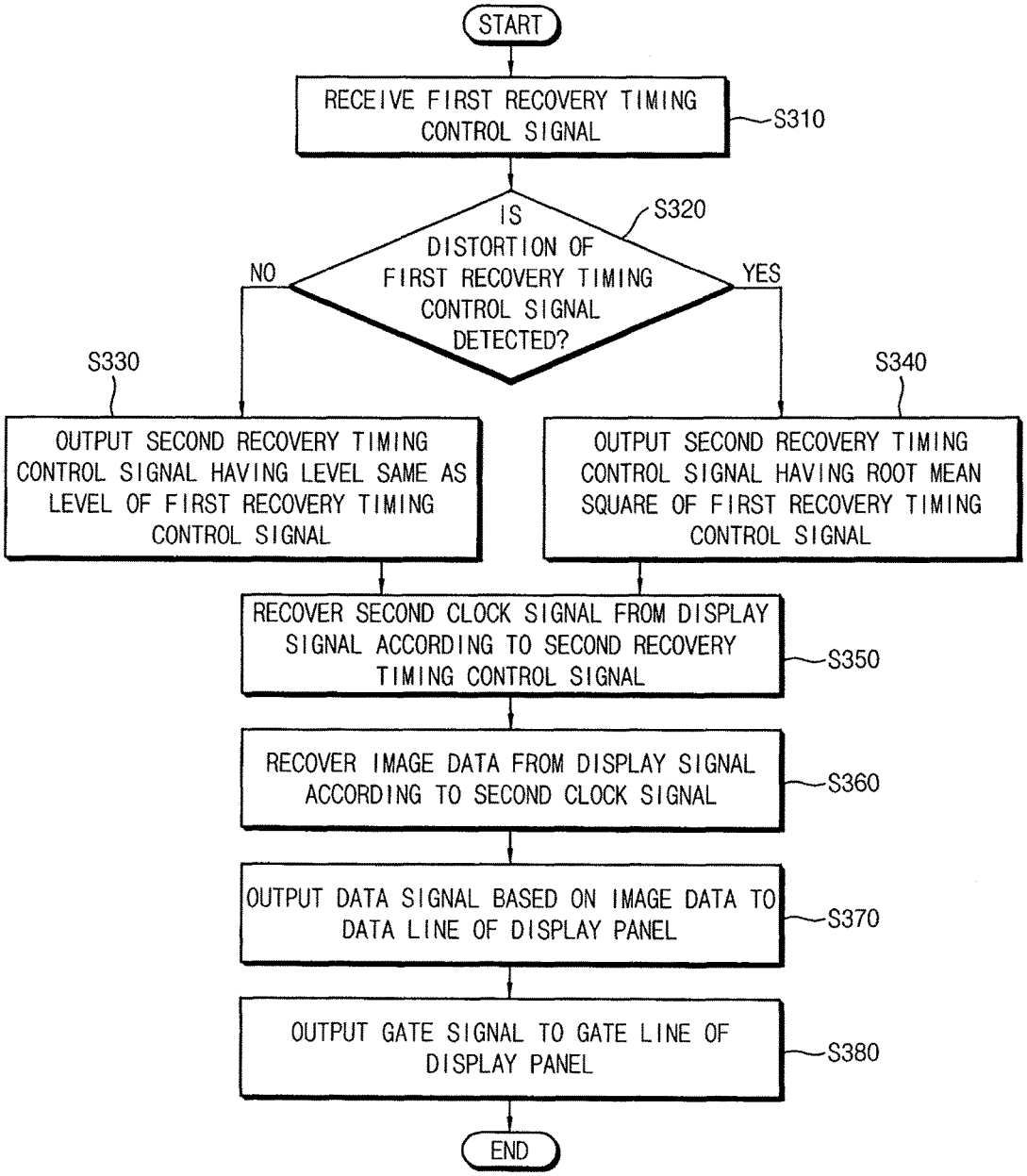
FIG. 11 is a flow chart illustrating a method of driving a display panel performed by a display panel driving apparatus of FIG. 10 according to an exemplary embodiment of the present inventive concept.

FIG. 11 is a flow chart illustrating a method of driving a display panel performed by the display panel driving apparatus of FIG. 10 according to an exemplary embodiment of the inventive concept.

Referring to FIGS. 2, 3, 10 and 11, the first recovery timing control signal SFC1 is received (step S310). Specifically, the root mean square calculating part 560 receives the first recovery timing control signal SFC1 from the timing controlling part 150.

It is determined whether the distortion is detected in the first recovery timing control signal SFC1 (step S320). Specifically, the distortion detecting part 561 determines whether the first recovery timing control signal SFC1 swings at least once within the reference time or the glitch or spike is present in the first recovery timing control signal SFC1 every reference time defined in the root mean square time control signal RST to determine whether the distortion is present in the first recovery timing control signal SFC1.

The second recovery timing control signal SFC2 having the level substantially the same as the level of the first recovery timing control signal SFC1 is output while the distortion of the first recovery timing control signal SFC1 is not detected (step S330).

The second recovery timing control signal SFC2 having the root mean square of the first recovery timing control signal SFC1 is output while the distortion of the first recovery timing control signal SFC1 is detected (step S340). Thus, the second recovery timing control signal SFC2 has the level substantially the same as the level of the first recovery timing control signal SFC1 in the period when the distortion is not generated in the first recovery timing control signal SFC1 and has the root mean square of the first recovery timing control signal SFC1 while the distortion is generated in the first recovery timing control signal SFC1.

The second clock signal CLK2 is recovered from the display signal DIS according to the second recovery timing control signal SFC2 (step S350). Specifically, the clock recovering part 210 or 410 recovers the second clock signal CLK2 from the display signal DIS including the image data DATA and the second clock signal CLK2.

The clock recovering part 210 or 410 recovers the second clock signal CLK2 from the display signal DIS according to the second recovery timing control signal SFC2 during the vertical blank period when the data driving part 140 does not output the data signal DS to the data lines DL. For example, the period when the second recovery timing control signal SFC2 is a low level may be the vertical blank period. Alternatively, the period when the second recovery timing control signal SFC2 is a high level may be the vertical blank period. The clock recovering part 210 or 410 may determine that the level of the second recovery timing control signal SFC2 is the first level LEVEL1 which is the high level when the level of the second recovery timing control signal SFC2 is close to the first level LEVEL1 which is the high level rather than the second level LEVEL2 which is the low level. In addition, the clock recovering part 210 or 410 may determine that the level of the second recovery timing control signal SFC2 is the second level LEVEL2 which is the low level when the level of the second recovery timing control signal SFC2 is close to the second level LEVEL2 which is the low level rather than the first level LEVEL1 which is the high level. The clock recovering part 210 or 410 recovers the second clock signal CLK2 from the display signal DIS to output the second clock signal CLK2 to the data recovering part 220.

The image data DATA is recovered from the display signal DIS according to the second clock signal CLK2 (step S360). Specifically, the data recovering part 220 recovers the image data DATA from the display signal DIS according to the second clock signal CLK2 received from the clock recovering part 210. The data recovering part 220 outputs the image data DATA to the serial parallel converting part 240.

The data signal DS based on the image data DATA is output to the data lines DL of the display panel 110 (step S370). Specifically, the serial parallel converting part 240 receives the image data DATA from the data recovering part 220, and converts the image data DATA into the parallel data DATA1 to DATAk to output the parallel data DATA1 to DATAk. The shift register part 230 shifts the horizontal start signal STH to generate enable signals En1 to Enk, and provides the enable signals En1 to Enk to the latch part 250. The serial parallel converting part 240 provides the parallel data DATA1 to DATAk to the latch part 250. The latch part 250 stores the parallel data DATA1 to DATAk, and outputs the parallel data the DATA1 to DATAk to the digital analog converting part 260. The digital analog converting part 260 receives the parallel data DATA1 to DATAk from the latch part 250, and converts the parallel data DATA1 to DATAk into the analog data ADATA1 to ADATAk to output the analog data ADATA1 to ADATAk to the buffer part 270. The buffer part 270 outputs the data signals DS1 to DSk to the data lines DL of the display panel 110. Here, the data signals DS1 to DSk may be included in the data signals DS of FIG. 1.

The gate signal GS is output to the gate line GL of the display panel 110 (step S380). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, the data driving part 140 recovers the second clock signal CLK2 from the display signal DIS according to the second recovery timing control signal SFC2 which is the root mean square of the first recovery timing control signal SFC1. Therefore, even when the distortion is included in the first recovery timing control signal SFC1, the data driving part 140 does not recognize the distortion of the first recovery timing control signal SFC1. Thus, an error in which the data driving part 140 recognizes a high level of the first recovery timing control signal SFC1 as a low level or recognizes a low level of the first recovery timing control signal SFC1 as a high level may be prevented. Therefore, an operation error of the data driving part 140 may be prevented, and thus display quality of the display apparatus 500 may be improved.

Figure 12:
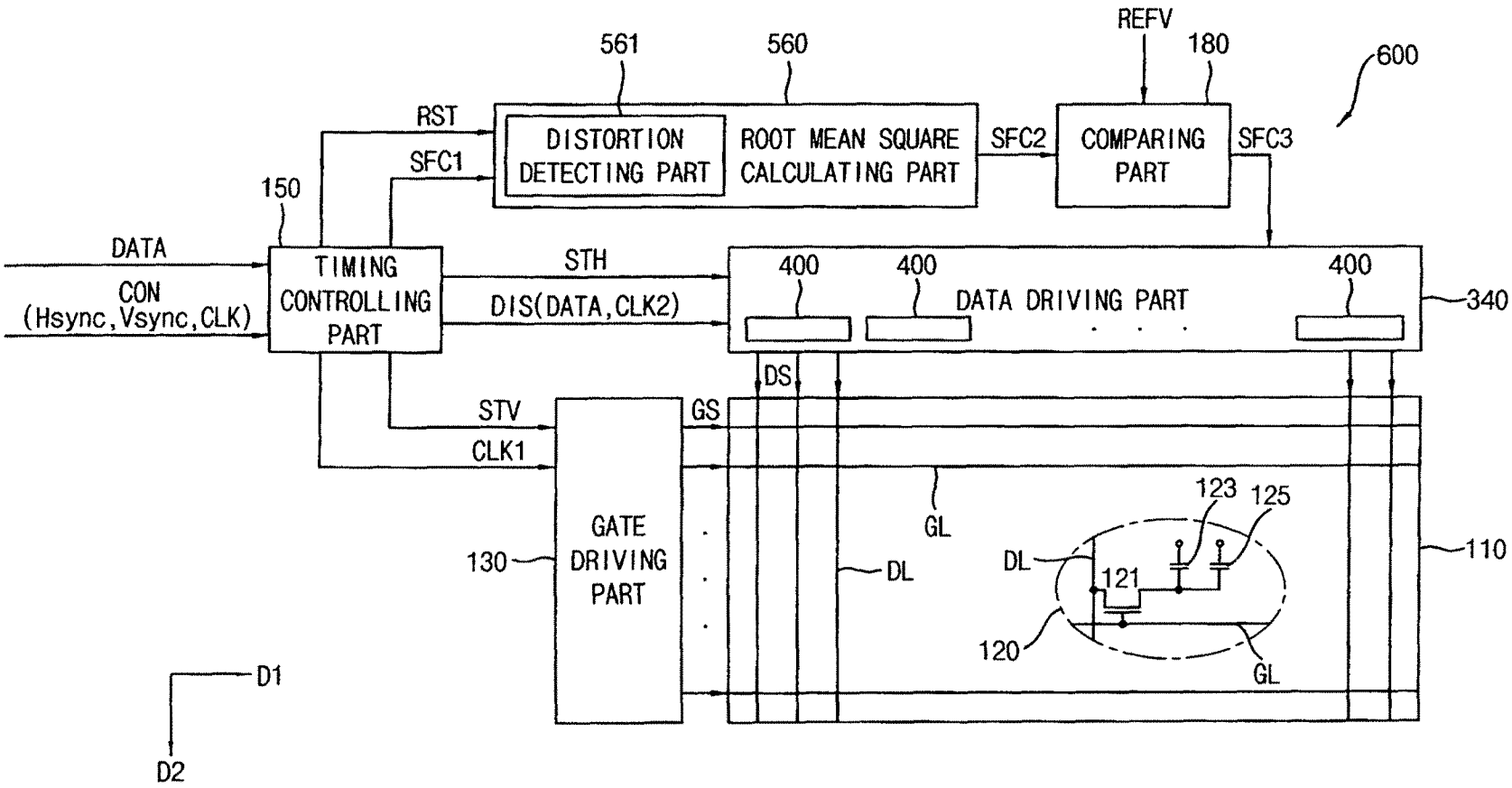
FIG. 12 is a block diagram illustrating a display apparatus according to an exemplary embodiment of the present inventive concept.

FIG. 12 is a block diagram illustrating a display apparatus according to an exemplary embodiment of the present inventive concept.

The display apparatus 600 according to the present exemplary embodiment is substantially the same as the display apparatus 500 according to the previous exemplary embodiment illustrated in FIG. 10 except for the data driving part 340 and the comparing part 180. In addition, the comparing part 180 according to the present exemplary embodiment is substantially the same as the comparing part 180 according to the previous exemplary embodiment illustrated in FIG. 5. In addition, the data driving part 340 according to the present exemplary embodiment is substantially the same as the data driving part 340 according to the previous exemplary embodiment illustrated in FIG. 5.

Thus, the same reference numerals will be used to refer to same or like parts as those described in the previous exemplary embodiment and any further repetitive explanation concerning the above elements will be omitted.

Referring to FIG. 12, the display apparatus 600 includes the display panel 110, the gate driving part 130, the data driving part 340, the timing controlling part 150, the root mean square calculating part 560 and the comparing part 180.

The gate driving part 130, the data driving part 340, the timing controlling part 150, the root mean square calculating part 560 and the comparing part 180 may be part of a display panel driving apparatus driving the display panel 110.

The root mean square calculating part 560 receives the first recovery timing control signal SFC1 and the root mean square time control signal RST from the timing controlling part 150. The root mean square calculating part 560 includes the distortion detecting part 561. The distortion detecting part 561 detects distortion within the first recovery timing control signal SFC1. For example, the distortion detecting part 561 may determine whether the first recovery timing control signal SFC1 swings at least once within the reference time or a glitch or spike is present in the first recovery timing control signal SFC1 every reference time defined in the root mean square time control signal RST.

The root mean square calculating part 560 outputs the second recovery timing control signal SFC2 having the level substantially the same as the level of the first recovery timing control signal SFC1 in the period when the distortion is not generated in the first recovery timing control signal SFC1. The root mean square calculating part 560 outputs the second recovery timing control signal SFC2 having the root mean square of the first recovery timing control signal SFC1 in the period when the distortion is generated in the first recovery timing control signal SFC1.

The comparing part 180 receives the second recovery timing control signal SFC2 from the root mean square calculating part 560, and receives the reference voltage REFV from an outside source. The comparing part 180 compares the second recovery timing control signal SFC2 with the reference voltage REFV to output the third recovery timing control signal SFC3

A waveforms diagram illustrating the root mean square time control signal RST, the first recovery timing control signal SFC1, the second recovery timing control signal SFC2 and the third recovery timing control signal SFC3 is substantially the same as the waveforms diagram illustrating the root mean square time control signal RST, the first recovery timing control signal SFC1, the second recovery timing control signal SFC2 and the third recovery timing control signal SFC3 of FIG. 7.

Figure 13:
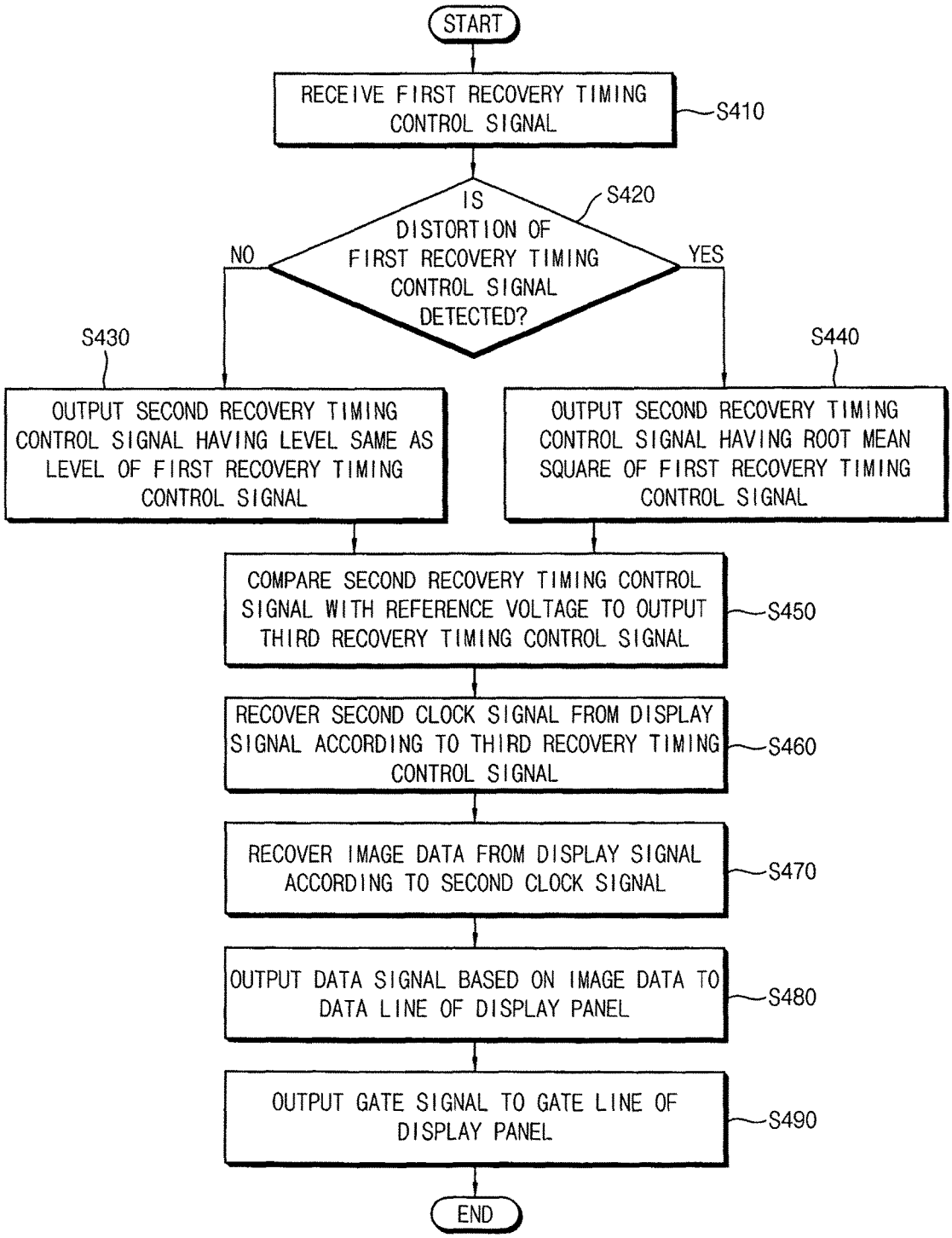
FIG. 13 is a flow chart illustrating a method of driving a display panel performed by a display panel driving apparatus of FIG. 12 according to an exemplary embodiment of the present inventive concept.

FIG. 13 is a flow chart illustrating a method of driving a display panel performed by the display panel driving apparatus of FIG. 12 according to an exemplary embodiment of the inventive concept. Referring to FIGS. 7, 8, 12 and 13, the first recovery timing control signal SFC1 is received (step S410). Specifically, the root mean square calculating part 560 receives the first recovery timing control signal SFC1 from the timing controlling part 150.

It is determined whether the distortion is detected in the first recovery timing control signal SFC1 (step S420). Specifically, the distortion detecting part 561 determines whether the first recovery timing control signal SFC1 swings at least once within the reference time or a glitch or spike is present in the first recovery timing control signal SFC1 every reference time defined in the root mean square time control signal RST to determine whether the distortion is generated in the first recovery timing control signal SFC1.

The second recovery timing control signal SFC2 having the level substantially the same as the level of the first recovery timing control signal SFC1 is output while the distortion of the first recovery timing control signal SFC1 is not detected (step S430).

The second recovery timing control signal SFC2 having the root mean square of the first recovery timing control signal SFC1 is output while the distortion of the first recovery timing control signal SFC1 is detected (step S440). Thus, the second recovery timing control signal SFC2 has the level substantially the same as the level of the first recovery timing control signal SFC1 in the period when the distortion is not generated in the first recovery timing control signal SFC1 and has the root mean square of the first recovery timing control signal SFC1 while the distortion is generated in the first recovery timing control signal SFC1.

The second recovery timing control signal SFC2 is compared with the reference voltage REFV to output the third recovery timing control signal SFC3 (step S450). Specifically, the comparing part 180 compares the second recovery timing control signal SFC2 with the reference voltage REFV to output the third recovery timing control signal SFC3. Thus, when the level of the second recovery timing control signal SFC2 is not less than the reference voltage REFV, the third recovery timing control signal SFC3 has the first level LEVEL1. In addition, when the level of the second recovery timing control signal SFC2 is less than the reference voltage REFV, the third recovery timing control signal SFC3 has the second level LEVEL2.

The second clock signal CLK2 is recovered from the display signal DIS according to the third recovery timing control signal SFC3 (step S460). Specifically, the clock recovering part 210 recovers the second clock signal CLK2 from the display signal DIS including the image data DATA and the second clock signal CLK2. The clock recovering part 210 recovers the second clock signal CLK2 from the display signal DIS according to the third recovery timing control signal SFC3 during the vertical blank period when the data driving part 340 does not output the data signal DS to the data lines DL. For example, the period when the third recovery timing control signal SFC3 is the low level may be the vertical blank period. Alternatively, the period when the third recovery timing control signal SFC3 is the high level may be the vertical blank period.

The clock recovering part 210 recovers the second clock signal CLK2 from the display signal DIS to output the second clock signal CLK2 to the data recovering part 220.

The image data DATA is recovered from the display signal DIS according to the second clock signal CLK2 (step S470). Specifically, the data recovering part 220 recovers the image data DATA from the display signal DIS according to the second clock signal CLK2 received from the clock recovering part 410. The data recovering part 220 outputs the image data DATA to the serial parallel converting part 240.

The data signal DS based on the image data DATA is output to the data lines DL of the display panel 110 (step S480). Specifically, the serial parallel converting part 240 receives the image data DATA from the data recovering part 220, and converts the image data DATA into the parallel data DATA1 to DATAk to output the parallel data DATA1 to DATAk. The shift register part 230 shifts the horizontal start signal STH to generate enable signals En1 to Enk, and provides the enable signals En1 to Enk to the latch part 250. The serial parallel converting part 240 provides the parallel data DATA1 to DATAk to the latch part 250. The latch part 250 stores the parallel data DATA1 to DATAk, and outputs the parallel data the DATA1 to DATAk to the digital analog converting part 260. The digital analog converting part 260 receives the parallel data DATA1 to DATAk from the latch part 250, and converts the parallel data DATA1 to DATAk into the analog data ADATA1 to ADATAk to output the analog data ADATA1 to ADATAk to the buffer part 270. The buffer part 270 outputs the data signals DS1 to DSk to the data lines DL of the display panel 110. Here, the data signals DS1 to DSk may be included in the data signals DS of FIG. 1.

The gate signal GS is output to the gate line GL of the display panel 110 (step S490). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, the data driving part 340 recovers the second clock signal CLK2 from the display signal DIS according to the third recovery timing control signal SFC3 having the first level LEVEL1 and the second level LEVEL2 based on the second recovery timing control signal SFC2 which is the root mean square of the first recovery timing control signal SFC1. Therefore, even when distortion is included in the first recovery timing control signal SFC1, the data driving part 340 does not recognize the distortion of the first recovery timing control signal SFC1.

Thus, an error in which the data driving part 340 recognizes a high level of the first recovery timing control signal SFC1 as a low level or recognizes a low level of the first recovery timing control signal SFC1 as a high level may be prevented. Therefore, an operation error of the data driving part 340 may be prevented, and thus display quality of the display apparatus 600 may be improved.

Figure 14:
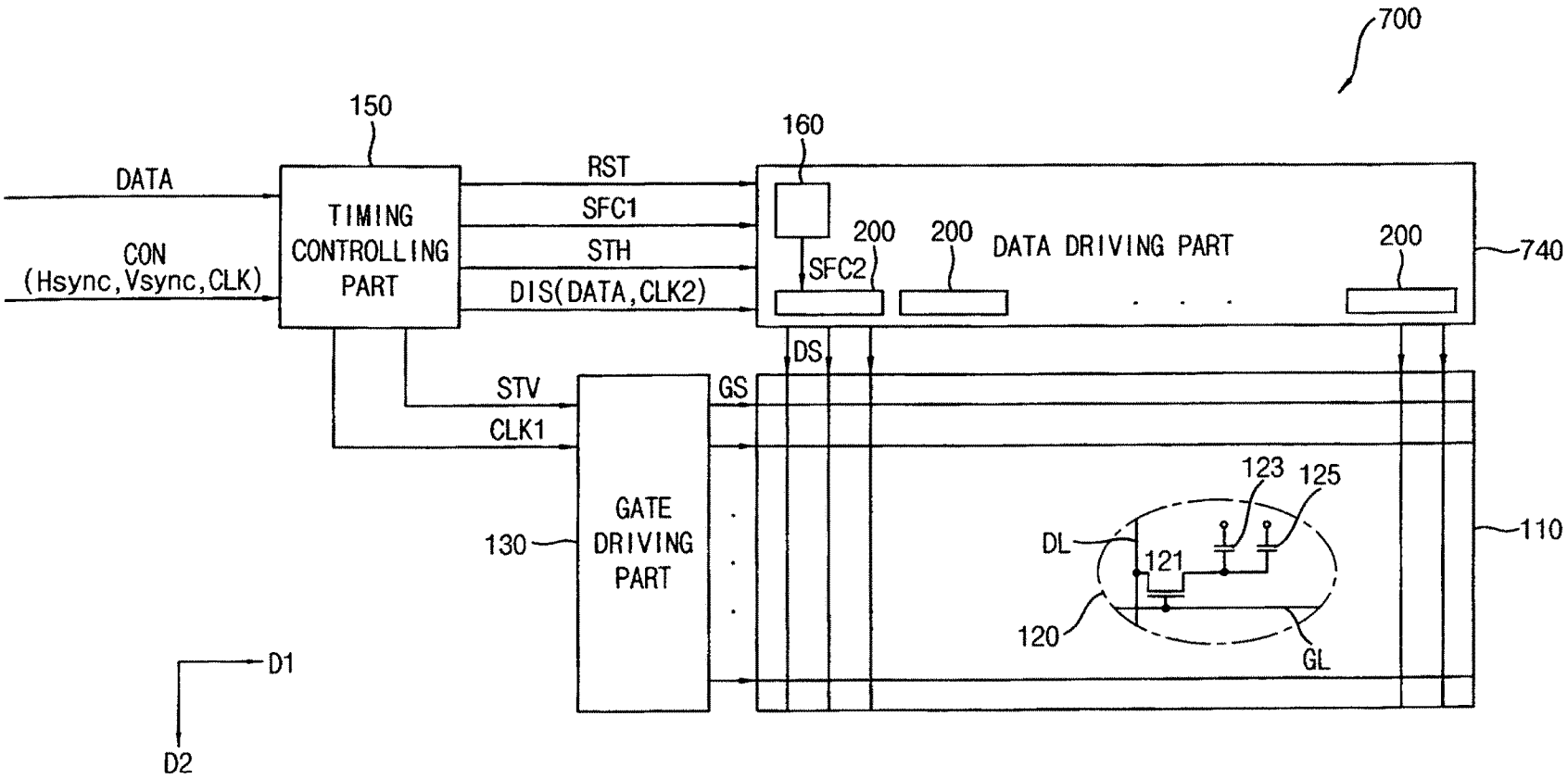
FIG. 14 is a block diagram illustrating a display apparatus according to an exemplary embodiment of the present inventive concept.

FIG. 14 is a block diagram illustrating a display apparatus according to an exemplary embodiment of the present inventive concept.

The display apparatus 700 according to the present exemplary embodiment is substantially the same as the display apparatus 100 according to the previous exemplary embodiment illustrated in FIG. 1 except for the root mean square calculating part 160 and a data driving part 740. Thus, the same reference numerals will be used to refer to same or like parts as those described in the previous exemplary embodiment and any further repetitive explanation concerning the above elements will be omitted.

Referring to FIG. 14, the display apparatus 700 according to the present exemplary embodiment includes the display panel 110, the gate driving part 130, the data driving part 740 and the timing controlling part 150.

The gate driving part 130, the data driving part 740 and the timing controlling part 150 may be part of a display panel driving apparatus driving the display panel 110.

The data driving part 740 includes the root mean square calculating part 160 and at least one data driving integrated circuit part 200. Thus, the root mean square calculating part 160 is located within the data driving part 740. The data driving part 740 outputs the data signals DS to the data lines DL in response to the horizontal start signal STH provided from the timing controlling part 150 and the second clock signal CLK2 included in the display signal DIS provided from the timing controlling part 150.

The root mean square calculating part 160 receives the first recovery timing control signal SFC1 and the root mean square time control signal RST from the timing controlling part 150. The root mean square calculating part 160 calculates the root mean square of the first recovery timing control signal SFC1 to output the second recovery timing control signal SFC2. The root mean square calculating part 160 calculates the root mean square of the first recovery timing control signal SFC1 every reference time according to the root mean square time control signal RST.

The data driving part 740 recovers the second clock signal CLK2 from the display signal DIS according to the second recovery timing control signal SFC2.

A waveforms diagram illustrating the root mean square time control signal RST, the first recovery timing control signal SFC1 and the second recovery timing control signal SFC2 is substantially the same as the waveforms diagram illustrating the root mean square time control signal RST, the first recovery timing control signal SFC1 and the second recovery timing control signal SFC2 of FIG. 2.

In addition, a method of driving a display panel performed by the display panel driving apparatus of FIG. 14 is substantially the same as the method of driving the display panel of FIG. 4.

Thus, according to the present exemplary embodiment, the data driving part 740 recovers the second clock signal CLK2 from the display signal DIS according to the second recovery timing control signal SFC2 which is the root mean square of the first recovery timing control signal SFC1. Therefore, even when the distortion is included in the first recovery timing control signal SFC1, the data driving part 740 does not recognize the distortion of the first recovery timing control signal SFC1. Thus, an error in which the data driving part 740 recognizes a high level of the first recovery timing control signal SFC1 as a low level or recognizes a low level of the first recovery timing control signal SFC1 as a high level may be prevented. Therefore, an operation error of the data driving part 740 may be prevented, and thus display quality of the display apparatus 700 may be improved.

Figure 15:
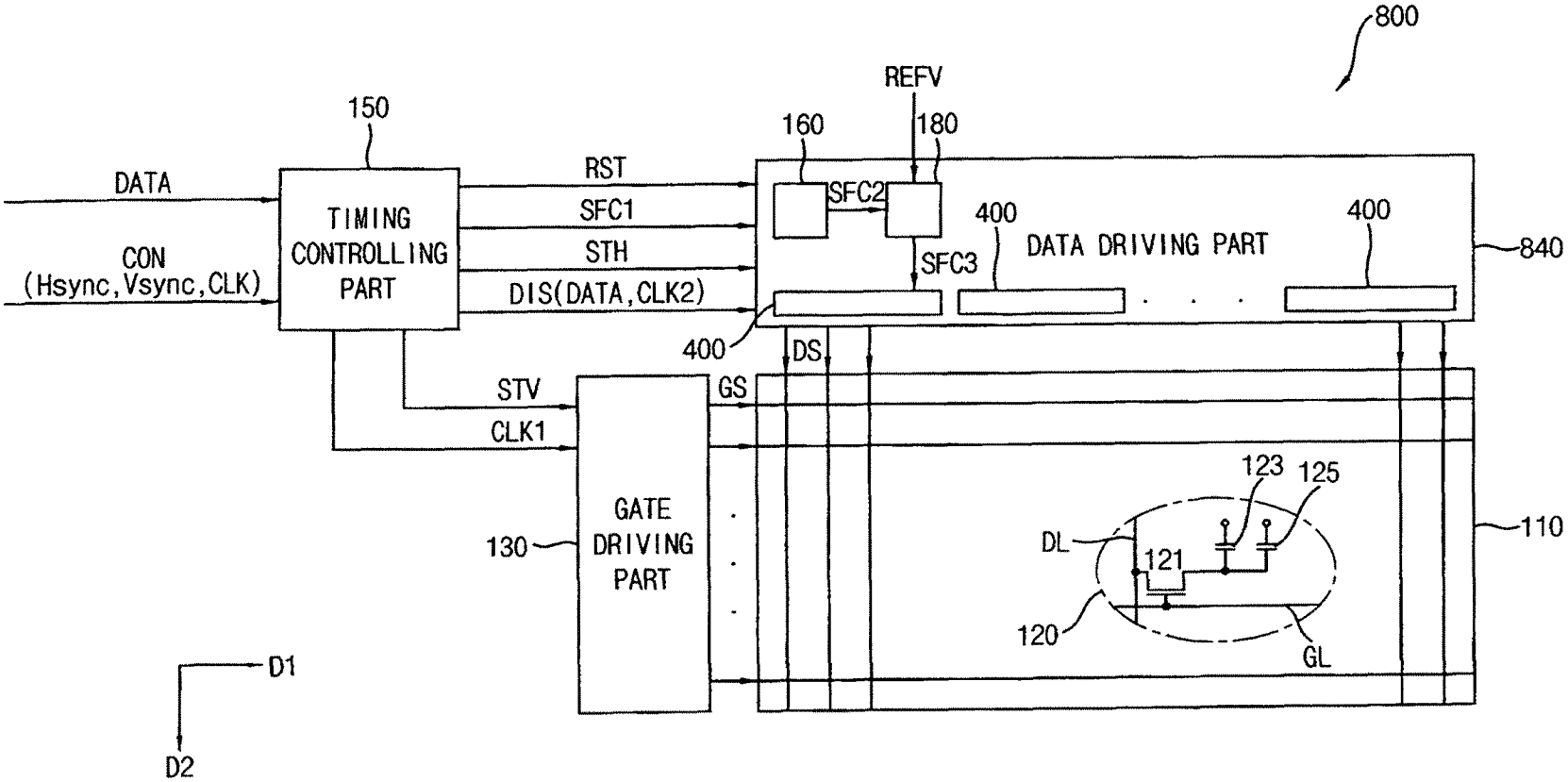
FIG. 15 is a block diagram illustrating a display apparatus according to an exemplary embodiment of the present inventive concept.

FIG. 15 is a block diagram illustrating a display apparatus according to an exemplary embodiment of the present inventive concept.

The display apparatus 800 according to the present exemplary embodiment is substantially the same as the display apparatus 300 according to the previous exemplary embodiment illustrated in FIG. 5 except for the root mean square calculating part 160 and a data driving part 840. Thus, the same reference numerals will be used to refer to same or like parts as those described in the previous exemplary embodiment and any further repetitive explanation concerning the above elements will be omitted.

Referring to FIG. 15, the display apparatus 800 according to the present exemplary embodiment includes the display panel 110, the gate driving part 130, the data driving part 840 and the timing controlling part 150.

The gate driving part 130, the data driving part 840 and the timing controlling part 150 may be part of a display panel driving apparatus driving the display panel 110.

The data driving part 840 includes the root mean square calculating part 160 and at least one data driving integrated circuit part 400. Thus, the root mean square calculating part 160 and the comparing part 180 are located within the data driving part 840. The data driving part 840 outputs the data signals DS to the data lines DL in response to the horizontal start signal STH provided from the timing controlling part 150 and the second clock signal CLK2 included in the display signal DIS provided from the timing controlling part 150.

The root mean square calculating part 160 receives the first recovery timing control signal SFC1 and the root mean square time control signal RST from the timing controlling part 150. The root mean square calculating part 160 calculates the root mean square of the first recovery timing control signal SFC1 to output the second recovery timing control signal SFC2. The root mean square calculating part 160 may calculate the root mean square of the first recovery timing control signal SFC1 every reference time according to the root mean square time control signal RST.

The comparing part 180 receives the second recovery timing control signal SFC2 from the root mean square calculating part 160 and receives the reference voltage REFV from an outside source. The comparing part 180 compares the second recovery timing control signal SFC2 with the reference voltage REFV to output the third recovery timing control signal SFC3.

The data driving part 840 recovers the second clock signal CLK2 from the display signal DIS according to the third recovery timing control signal SFC3.

A waveforms diagram illustrating the root mean square time control signal RST, the first recovery timing control signal SFC1, the second recovery timing control signal SFC2 and the third recovery timing control signal SFC3 is substantially the same as the waveforms diagram illustrating the root mean square time control signal RST, the first recovery timing control signal SFC1, the second recovery timing control signal SFC2 and the third recovery timing control signal SFC3 of FIG. 7.

In addition, a method of driving a display panel performed by the display panel driving apparatus of FIG. 15 is substantially the same as the method of driving the display panel of FIG. 9.

Thus, according to the present exemplary embodiment, the data driving part 840 recovers the second clock signal CLK2 from the display signal DIS according to the third recovery timing control signal SFC3 having the first level LEVEL1 and the second level LEVEL2 based on the second recovery timing control signal SFC2 which is the root mean square of the first recovery timing control signal SFC1. Therefore, even when distortion is included in the first recovery timing control signal SFC1, the data driving part 840 does not recognize the distortion of the first recovery timing control signal SFC1.

Thus, an error in which the data driving part 840 recognizes a high level of the first recovery timing control signal SFC1 as a low level or recognizes a low level of the first recovery timing control signal SFC1 as a high level may be prevented. Therefore, an operation error of the data driving part 840 may be prevented, and thus display quality of the display apparatus 800 may be improved.

Figure 16:
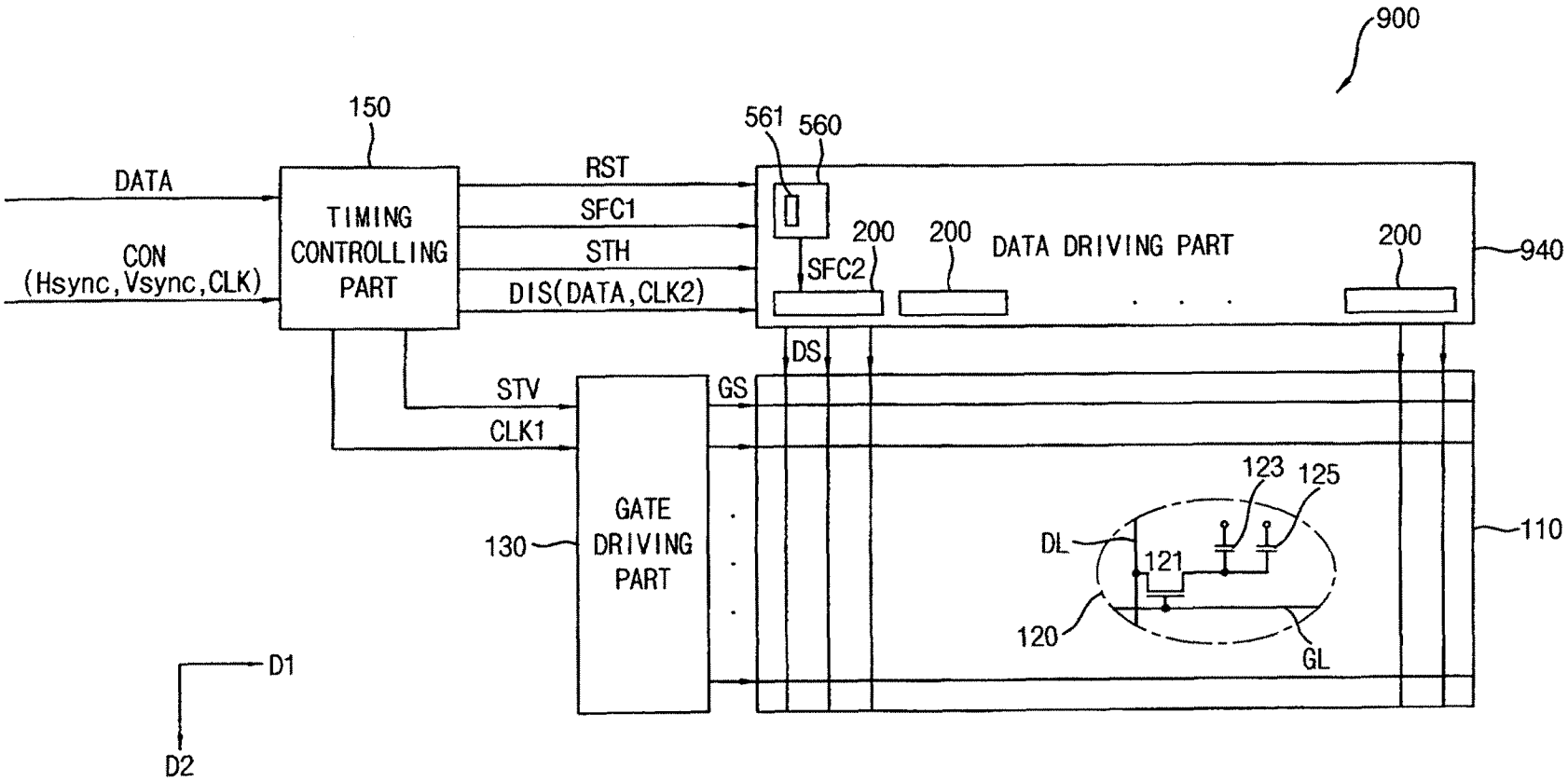
FIG. 16 is a block diagram illustrating a display apparatus according to an exemplary embodiment of the present inventive concept.

FIG. 16 is a block diagram illustrating a display apparatus according to an exemplary embodiment of the present inventive concept.

The display apparatus 900 according to the present exemplary embodiment is substantially the same as the display apparatus 500 according to the previous exemplary embodiment illustrated in FIG. 10 except for the root mean square calculating part 560 and a data driving part 940. Thus, the same reference numerals will be used to refer to same or like parts as those described in the previous exemplary embodiment and any further repetitive explanation concerning the above elements will be omitted.

Referring to FIG. 16, the display apparatus 900 according to the present exemplary embodiment includes the display panel 110, the gate driving part 130, the data driving part 940 and the timing controlling part 150.

The gate driving part 130, the data driving part 940 and the timing controlling part 150 may be part of a display panel driving apparatus driving the display panel 110.

The data driving part 940 includes the root mean square calculating part 560 and at least one data driving integrated circuit part 200. Thus, the root mean square calculating part 560 is located within the data driving part 940. The data driving part 940 outputs the data signals DS to the data lines DL in response to the horizontal start signal STH provided from the timing controlling part 150 and the second clock signal CLK2 included in the display signal DIS provided from the timing controlling part 150.

The root mean square calculating part 560 receives the first recovery timing control signal SFC1 and the root mean square time control signal RST from the timing controlling part 150. The root mean square calculating part 560 includes the distortion detecting part 561. The distortion detecting part 561 detects whether distortion is present in the first recovery timing control signal SFC1. The root mean square calculating part 560 outputs the second recovery timing control signal SFC2 having the level substantially the same as the level of the first recovery timing control signal SFC1 in the period when the distortion is not present in the first recovery timing control signal SFC1 and having the root mean square of the first recovery timing control signal SFC1 in the period when the distortion is present in the first recovery timing control signal SFC1.

The data driving part 940 recovers the second clock signal CLK2 from the display signal DIS according to the second recovery timing control signal SFC2.

A waveforms diagram illustrating the root mean square time control signal RST, the first recovery timing control signal SFC1 and the second recovery timing control signal SFC2 is substantially the same as the waveforms diagram illustrating the root mean square time control signal RST, the first recovery timing control signal SFC1 and the second recovery timing control signal SFC2 of FIG. 2.

In addition, a method of driving a display panel performed by the display panel driving apparatus of FIG. 16 is substantially the same as the method of driving the display panel of FIG. 11.

Thus, according to the present exemplary embodiment, the data driving part 940 recovers the second clock signal CLK2 from the display signal DIS according to the second recovery timing control signal SFC2 which is the root mean square of the first recovery timing control signal SFC1. Therefore, even when distortion is included in the first recovery timing control signal SFC1, the data driving part 940 does not recognize the distortion of the first recovery timing control signal SFC1. Thus, an error in which the data driving part 940 recognizes a high level of the first recovery timing control signal SFC1 as a low level or recognizes a low level of the first recovery timing control signal SFC1 as a high level may be prevented. Therefore, an operation error of the data driving part 940 may be prevented, and thus display quality of the display apparatus 900 may be improved.

Figure 17:
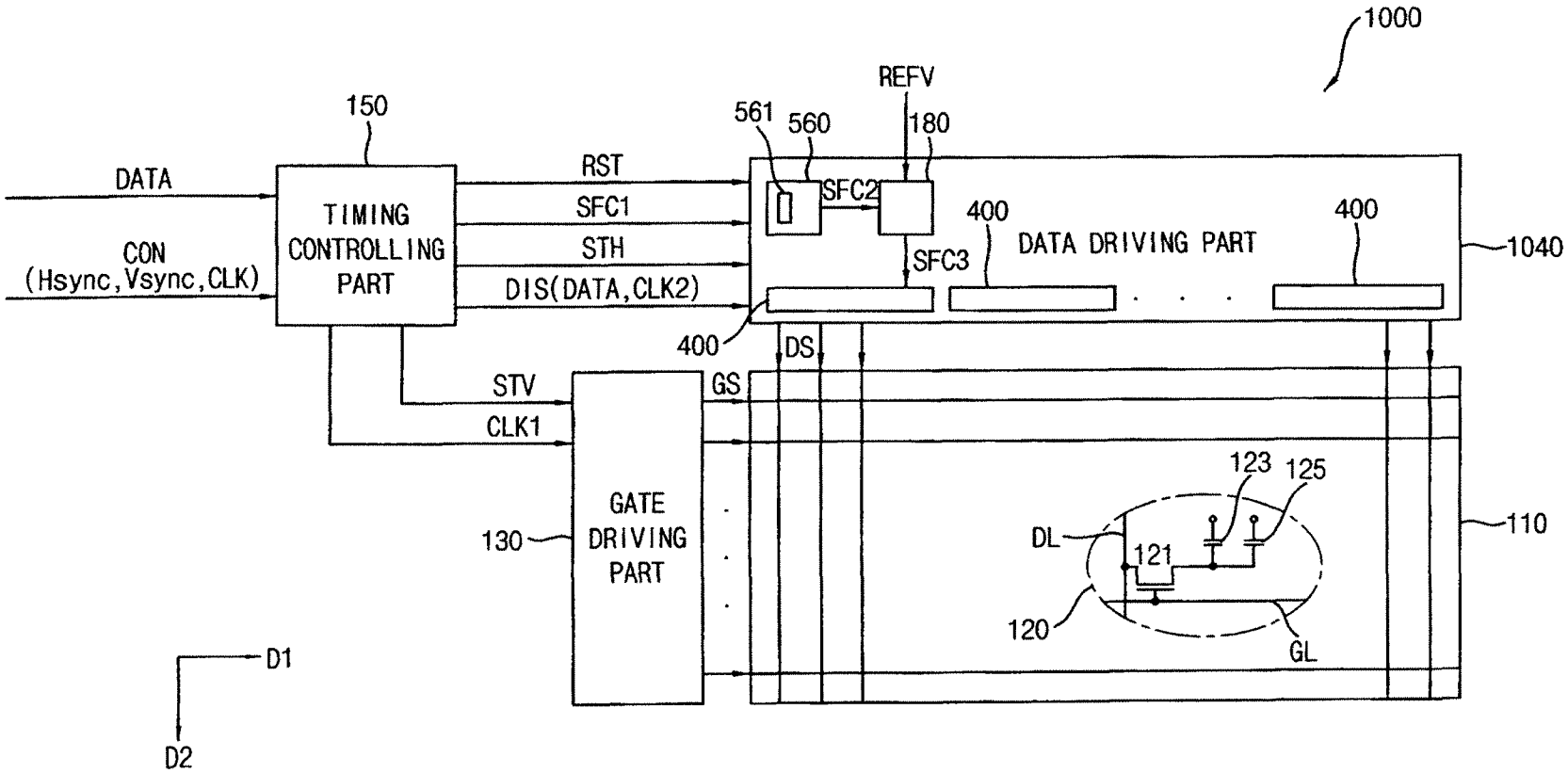
FIG. 17 is a block diagram illustrating a display apparatus according to an exemplary embodiment of the present inventive concept.

FIG. 17 is a block diagram illustrating a display apparatus according to an exemplary embodiment of the present inventive concept.

The display apparatus 1000 according to the present exemplary embodiment is substantially the same as the display apparatus 600 according to the previous exemplary embodiment illustrated in FIG. 12 except for the root mean square calculating part 560, the comparing part 180 and a data driving part 1040. Thus, the same reference numerals will be used to refer to same or like parts as those described in the previous exemplary embodiment and any further repetitive explanation concerning the above elements will be omitted.

Referring to FIG. 17, the display apparatus 1000 according to the present exemplary embodiment includes the display panel 110, the gate driving part 130, the data driving part 1040 and the timing controlling part 150.

The gate driving part 130, the data driving part 1040 and the timing controlling part 150 may be part of a display panel driving apparatus driving the display panel 110.

The data driving part 1040 includes the root mean square calculating part 560, the comparing part 180 and at least one data driving integrated circuit part 400. Thus, the root mean square calculating part 560 and the comparing part 180 are located within the data driving part 1040. The data driving part 1040 outputs the data signals DS to the data lines DL in response to the horizontal start signal STH provided from the timing controlling part 150 and the second clock signal CLK2 included in the display signal DIS provided from the timing controlling part 150.

The root mean square calculating part 560 receives the first recovery timing control signal SFC1 and the root mean square time control signal RST from the timing controlling part 150. The root mean square calculating part 560 includes the distortion detecting part 561. The distortion detecting part 561 detects whether distortion is present in the first recovery timing control signal SFC1. The root mean square calculating part 560 outputs the second recovery timing control signal SFC2 having the level substantially the same as the level of the first recovery timing control signal SFC1 in the period when the distortion is not present in the first recovery timing control signal SFC1 and having the root mean square of the first recovery timing control signal SFC1 in the period when the distortion is present in the first recovery timing control signal SFC1.

The comparing part 180 receives the second recovery timing control signal SFC2 from the root mean square calculating part 160 and receives the reference voltage REFV from an outside source. The comparing part 180 compares the second recovery timing control signal SFC2 with the reference voltage REFV to output the third recovery timing control signal SFC3.

The data driving part 1040 recovers the second clock signal CLK2 from the display signal DIS according to the third recovery timing control signal SFC3.

A waveforms diagram illustrating the root mean square time control signal RST, the first recovery timing control signal SFC1, the second recovery timing control signal SFC2 and the third recovery timing control signal SFC3 is substantially the same as the waveforms diagram illustrating the root mean square time control signal RST, the first recovery timing control signal SFC1, the second recovery timing control signal SFC2 and the third recovery timing control signal SFC3 of FIG. 7.

In addition, a method of driving a display panel performed by the display panel driving apparatus of FIG. 17 is substantially the same as the method of driving the display panel of FIG. 13.

Thus, according to the present exemplary embodiment, the data driving part 1040 recovers the second clock signal CLK2 from the display signal DIS according to the third recovery timing control signal SFC3 having the first level LEVEL1 and the second level LEVEL2 based on the second recovery timing control signal SFC2 which is the root mean square of the first recovery timing control signal SFC1. Therefore, even when distortion is included in the first recovery timing control signal SFC1, the data driving part 1040 does not recognize the distortion of the first recovery timing control signal SFC1. Thus, an error in which the data driving part 1040 recognizes a high level of the first recovery timing control signal SFC1 as a low level or recognizes a low level of the first recovery timing control signal SFC1 as a high level may be prevented. Therefore, an operation error of the data driving part 1040 may be prevented, and thus display quality of the display apparatus 1000 may be improved.

Embodiments of the inventive concept provide a display panel driving apparatus, a method of driving a display panel using the display panel driving apparatus, and a display apparatus having the display panel driving apparatus. In these embodiments, even when distortion is present in a recovery timing control signal for controlling a recovery timing when a clock signal is recovered from a display signal including image data and the clock signal, a data driving part does not recognize the distortion of the recovery timing control signal. Therefore, an operation error of the data driving part may be prevented, and thus display quality of a display apparatus including the data driving part may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display panel driving apparatus comprising:

a control circuit configured to receive a first control signal for recovering a clock signal from a display signal including image data and the clock signal, and calculate a root mean square of the first control signal to output a second control signal;

a data driver configured to receive the display signal, recover the clock signal from the display signal based on the second control signal, and output a data signal based on the image data to a data line of a display panel; and a gate driver configured to output a gate signal to a gate line of the display panel.

2. The display panel driving apparatus of claim 1, wherein the control circuit calculates the root mean square of the first control signal every reference time.

3. The display panel driving apparatus of claim 1, further comprising: a detecting circuit configured to detect whether distortion is present in the first control signal.

4. The display panel driving apparatus of claim 3, wherein the control circuit calculates the root mean square of the first control signal while the distortion is present in the first control signal.

5. The display panel driving apparatus of claim 1, wherein the first control signal transits from a first level to a second level different from the first level or transits front the second level to the first level, and wherein, when a level of the second control signal is closer to the first level than the second level, the data driver determines that the level of the second control signal is the first level, and when the level of the second control signal is closer to the second level than the first level, the data driver determines that the level of the second control signal is the second level.

6. The display panel driving apparatus of claim 1, further comprising:

a comparator configured to compare the second control signal with a reference voltage to output a third control signal.

7. The display panel driving apparatus of claim 6, wherein the first control signal transits from a first level to a second level different from the first level or transits from the second level to the first level, wherein the reference voltage has a medium value of the first level and the second level, and wherein, when a level of the second control signal is closer to the first level than the reference voltage, a level of the third control signal is the first level, and when the level of the second control signal is closer to the second level than the reference voltage, the level of the third control signal is the second level.

8. The display panel driving apparatus of claim 7, further comprising: a detecting circuit configured to detect whether distortion is present in the first control signal.

9. The display panel driving apparatus of claim 8, wherein the control circuit calculates the root mean square of the first control signal while the distortion is present in the first control signal.

10. The display panel driving apparatus of claim 7, wherein the control circuit and the comparator are included within the data driver.

11. The display panel driving apparatus of claim 1, wherein the control circuit is included within the data driver.

12. The display panel driving apparatus of claim 1, wherein the data driver recovers the clock signal from the display signal during a vertical blank period when the data signal is not output to the data line.

13. The display panel driving apparatus of claim 1, wherein the data driver comprises: a first circuit configured to recover the clock signal from the display signal; and a second circuit configured to recover the image data from the display signal according to the clock signal.

14. A method of driving a display panel, the method comprising:

receiving a first control signal for recovering a clock signal from a display signal including image data and the clock signal;

calculating a root mean square of the first control signal to output a second control signal;

recovering the clock signal from the display signal based on the second control signal;

recovering the image data from the display signal according to the clock signal;

outputting a data signal based on the image data to a data line of a display panel; and outputting a gate signal to a gate line of the display panel.

15. The method of claim 14, further comprising:

detecting whether distortion is present in the first control signal, wherein the outputting the second control signal comprises calculating the root mean square of the first control signal while the distortion is present in the first control signal.

16. The method of claim 14, further comprising:

comparing the second control signal with a reference voltage to output a third control signal; and recovering the clock signal from the display signal according to the third control signal.

17. A display apparatus comprising:

a display panel including a gate line, a data line and a pixel electrode electrically connected to the gate line and the data line; and a display panel driving apparatus comprising a control circuit configured to receive a first control signal for recovering a clock signal from a display signal including image data and the clock signal, and calculate a root mean square of the first control signal to output a second control signal, a data driver configured to receive the display signal, recover the clock signal from the display signal based on the second control signal, and output a data signal based on the image data to the data line of the display panel, and a gate driver configured to output a gate signal to the gate line of the display panel.

18. The display apparatus of claim 17, wherein the first control signal transits from a first level to a second level different from the first level or transits from the second level to the first level, and wherein, when a level of the second control signal is closer to the first level than the second level, the data driver determines that the level of the second control signal is the first level, and when the level of the second control signal is closer to the second level than the first level, the data driving part determines that the level of the second control signal is the second level.

19. The display apparatus of claim 17, wherein the display panel driving apparatus further comprises a comparator configured to compare the second control signal with a reference voltage to output a third control signal.

20. The display apparatus of claim 19, Wherein the first control signal transits from a first level to a second level different from the first level or transits from the second level to the first level, wherein the reference voltage has a medium value of the first level and the second level, and wherein, when a level of the second control signal is closer to the first level than the reference voltage, a level of the third control signal is the first level, and when the level of the second control signal is closer to the second level than the reference voltage, the level of the third control signal is the second level.

* * * * *